US006793232B1

(12) United States Patent
Wing

(10) Patent No.: US 6,793,232 B1
(45) Date of Patent: Sep. 21, 2004

(54) TRANSPORT CHAIR FOR A PATIENT

(75) Inventor: Thomas W. Wing, Claremont, CA (US)

(73) Assignee: O-Matic Corp., Claremont, CA (US)

( * ) Notice: Subject to any disclaimer, the term of this patent is extended or adjusted under 35 U.S.C. 154(b) by 0 days.

(21) Appl. No.: 10/729,203

(22) Filed: Dec. 5, 2003

Related U.S. Application Data

(63) Continuation-in-part of application No. 10/424,328, filed on Apr. 28, 2003.

(51) Int. Cl.[7] ..... A61G 7/00

(52) U.S. Cl. ..... 280/304.1; 280/47.41; 280/642; 5/604; 5/618; 297/188.11

(58) Field of Search ..... 280/250.1, 304.1, 280/47.41, 642, 643, 644, 6.152; 5/83.1, 604, 610, 618, 620; 4/483, 485; 297/188.1, 310, DIG. 4

(56) References Cited

U.S. PATENT DOCUMENTS 3,038,174 A * 6/1962 Donovan et al. ..... 5/611
4,856,123 A * 8/1989 Henderson et al. ..... 4/480
4,893,827 A 1/1990 Gay et al.
4,920,587 A * 5/1990 Kerr ..... 4/480
5,134,737 A * 8/1992 Wyman ..... 5/600
5,186,585 A 2/1993 Sousa
5,319,813 A * 6/1994 DiMatteo et al. ..... 5/81.1 C
5,398,357 A 3/1995 Foster
5,454,126 A * 10/1995 Foster et al. ..... 5/618
5,513,406 A * 5/1996 Foster et al. ..... 5/600
6,089,593 A 7/2000 Hanson
6,154,899 A * 12/2000 Brooke et al. ..... 5/81.1 R
6,315,319 B1 11/2001 Hanson
D473,826 S 4/2003 Schlangen
6,561,524 B1 5/2003 Medina
6,725,474 B2 * 4/2004 Foster et al. ..... 5/81.1 R

* cited by examiner

*Primary Examiner*—Avraham Lerner
(74) *Attorney, Agent, or Firm*—Stetina Brunda Garred & Brucker

(57) ABSTRACT

Disclosed is a wheelchair for a patient comprising a support frame, at least two main wheels mounted on sides of the support frame and a seat base disposed upon the support frame. Alternatively, a stretcher topping may be mounted upon a laterally slidable storage compartment that may be affixed to the support frame. The stretcher topping includes a seat base assembly having a removable seat panel stacked upon a potty panel with an aperture formed therethrough and opening into the storage compartment. The potty panel allows for evacuation of the patient while resting in the wheelchair. The seat base and the stretcher topping are configured for selectively raising and lowering the patient between first and second levels. At least one security beam is disposed on the wheelchair and may be configured as a hand hold for steadying the patient when transferring onto and off of the seat base.

22 Claims, 10 Drawing Sheets

Fig. 16
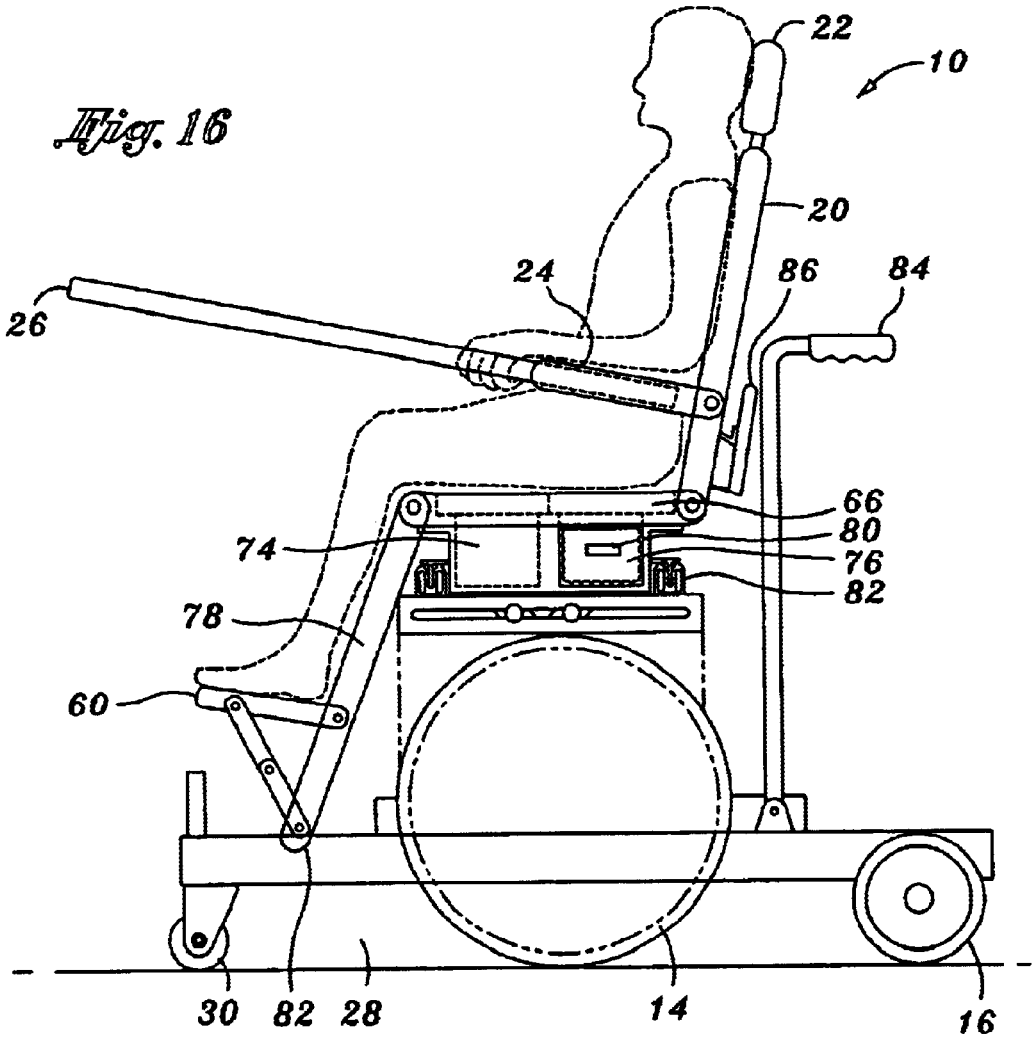
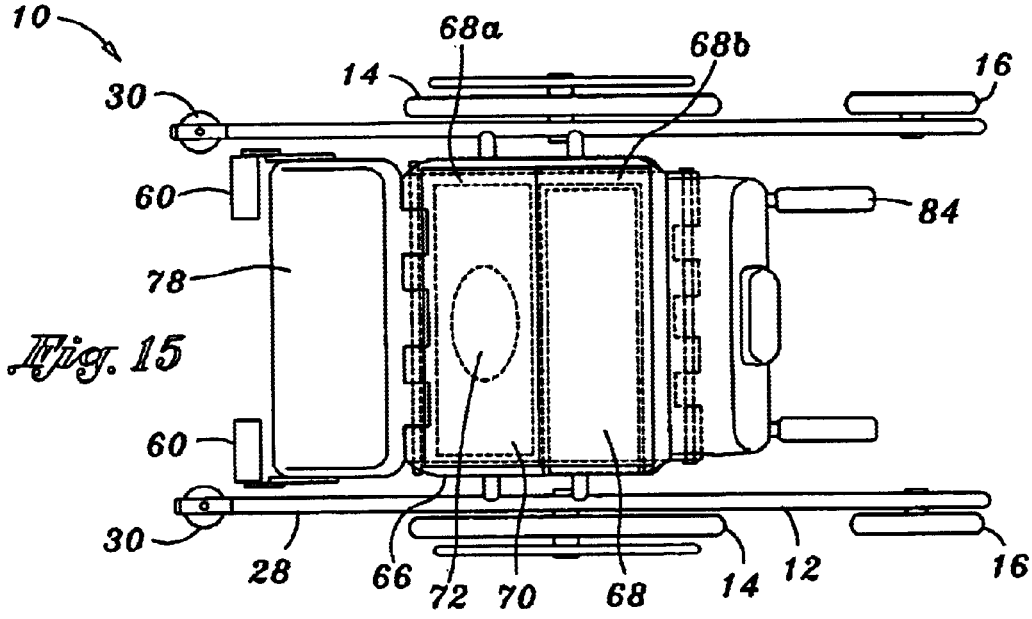
Fig. 15

TRANSPORT CHAIR FOR A PATIENT

CROSS-REFERENCE TO RELATED APPLICATIONS

This is a continuation-in-part of U.S. application Ser. No. 10/424,328 filed Apr. 28, 2003, the entire contents of which are incorporated by reference herein.

STATEMENT RE: FEDERALLY SPONSORED RESEARCH/DEVELOPMENT (Not Applicable)

BACKGROUND OF THE INVENTION

The present invention pertains generally to wheelchairs and, more particularly, a uniquely configured wheelchair specifically adapted for transferring a physically challenged patient into and out of the wheelchair under the patient's own power or with the assistance of no more than one person.

There exists in the prior art, wheelchairs that are configured to provide some degree of mobility to non-ambulatory or physically challenged patients. Some of these patients are confined to a wheelchair due to a variety of conditions including progressive neurological degeneration wherein the patient may be unable to move without the combined efforts of at least two people to lift the patient into and out of the wheelchair. For example, it may be desirable to relocate the patient from a bed in a bedroom to a living room chair in a living room. Unable to move under their own power due to lack of balance or muscular strength, the patient must be physically lifted from the bed, placed into the wheelchair, wheeled into the living room, and then lifted again out of the wheelchair and into the living room chair.

The lifting usually must be performed by two people or caregivers possessing sufficient strength, as one caregiver may not possess sufficient strength. In addition, the patient typically cannot be without a caregiver for more than six hours per day. Furthermore, the patient may require the assistance of a caregiver during the night in order to utilize bathroom facilities. Nursing homes may provide the assistance of caregivers who are specifically employed and trained to move nursing home patients.

Such caregivers in nursing homes can lift and move the patient at various times during the day and night, as needed. However, the cost of nursing homes is prohibitively expensive. The high cost of nursing homes and hospitals may not be covered under government health care plans or private health care insurance. Employing a full-time live in caregiver is equally expensive. In addition, insurance costs may prohibit live-in caregivers and nursing home caregivers from moving the patient outside the confines of the patient's home or the nursing home.

A few wheelchairs of the prior art are configured such that the patient does not have to be lifted out of the wheelchair in order to use the toilet or take a shower. Such wheelchairs include a seat panel having a potty dish formed therewith such that the patient may evacuate without the need to transfer the patient to a bathroom. However, such wheelchairs having a potty dish included with the seat panel suffer from several deficiencies that detract from the overall utility of the wheelchair. For example, because the potty dish is integral with the seat panel, the seat panel must be cleaned after each use.

In attempts to overcome the above mentioned limitations, electric wheelchairs have been developed. These electric wheelchairs include options such as powered seats that operate in a manner similar to the powered seats available in many automobiles. These powered seats may include a seat height adjustment capability that allows the patient to be raised above the level of an object to which the patient may be transferred. The lifting capability of the powered seats partially solves the lifting problem in that the need for two caregivers to lift the patient is eliminated.

However, powered wheelchairs may cost many thousands of dollars and thus may be unaffordable to the same people unable to afford the high cost of nursing homes. Furthermore, for patients having a diminished sense of balance, the gap between the wheelchair and the article to which the patient is to be moved presents another challenge in that the patient may not be able to transfer across the gap. A loss of balance while the patient is traversing the gap could be disastrous if a lone caregiver does not posses sufficient strength to steady the patient during the transfer.

Thus, there exists a need in the art for a wheelchair possessing the capability to raise the patient above the level of the article to which the patient may be transferred. Also, there exists a need in the art for a wheelchair capable of being lowering to a level that is less than that of the article from which the patient may be transferred. Additionally, there exists a need in the art for a wheelchair that provides the patient with the ability to steady and maintain their balance when transferring into and out of the wheelchair. Also, there exists a need in the art for a wheelchair that provides resistance from tipping over when the patient transfers into and out of the wheelchair. Furthermore, there exists a need in the art for a wheelchair that allows the patient to evacuate without transferring the patient to bathroom facilities. Finally, there exists a need in the art for a wheelchair that allows for easy cleanup after patient evacuation.

BRIEF SUMMARY OF THE INVENTION

The present invention specifically addresses and alleviates the above referenced deficiencies associated with wheelchairs. More particularly, the present invention is a uniquely configured wheelchair specifically adapted for transferring a patient into and out of the wheelchair by providing a combination of a selectively movable seat base with at least one security beam disposed on the wheelchair. The seat base is configured for selectively raising or lowering a patient between a first level and a second level such that the patient may be initially placed at a higher level than the article to which they are to be transferred. The patient then grabs the security beam for stability and balance and simultaneously moves downward and laterally to perform the transfer. In this manner, the force of gravity may be utilized to advantage so that the patient, either acting alone or with assistance, may easily transfer from the wheelchair to another location such as a living room chair or sofa, bathroom facilities or the passenger seat of an automobile, with the aid of no more than a single caregiver.

The wheelchair is comprised of a support frame to which is attached at least two main wheels, the seat base and at least one security beam. Additional components may include a pair of transit wheels, a pair of arm rests, a seat back and a head rest. As was mentioned above, the seat base is configured for selectively raising and lowering the patient between the first level and the second level as may be facilitated through various lifting mechanisms. The wheelchair may comprise a pair of anti-tip booms to prevent tipping during use of the security beams in patient transfers, as will be discussed in detail below.

A pair of transit wheels may be provided. The transit wheels may be mounted to the support frame and configured to be freely swivelable, providing lateral and forward/aft stability as well as steering capability to the wheelchair during normal operation. In comparison, the anti-tip booms provide lateral and forward/aft stability to prevent tipping of the wheelchair when the patient's weight is placed on the security beams during transfers into and out of the wheelchair. Thus, the distance between the main wheels and the respective ends of the anti-tip booms is fairly long as compared to the relatively short distance between the main wheels and the transit wheels.

The support frame has a front, a rear, and opposing sides with the front facing in a forward direction and the rear facing in an aft direction. The opposing sides of the support frame face in opposing lateral directions. The main wheels are mounted on the support frame and may be mounted on either side of the support frame. The seat base is disposed upon the support frame between the main wheels and is configured for selectively raising and lowering the patient between the first level and the second level. The lifting mechanism may comprise a scissors jack, a pneumatic or hydraulic jack or any number of alternative devices. The lifting mechanism may be configured for lowering the seat base to the first level such that the patient may be lifted off of the floor with the aid of the security beams. In such a scenario, the security beams may be horizontally oriented and slipped under the armpits of the patient in order to lift the patient up to a height sufficient for transfer into the wheelchair or into an adjacently located article of furniture.

The security beams may be substantially horizontally orientated and may project outwardly in the forward direction. The wheelchair may include only a single security beam or the pair of security beams disposed adjacent each of the main wheels. The security beams may alternatively have a substantially vertical orientation. The security beams 26 may be of a length such that they extend sufficiently past the wheelchair such that the patient sitting on an adjacent article of furniture may easily grasp the security beam prior to transferring into the wheelchair. The security beams may be axially extendable, such as by means of a telescoping configuration, such that the overall length may be adjusted beyond an initial length. The security beam may be configured to be pivoted and locked into any position intermediate the substantially vertical orientation and the substantially horizontal orientation.

If a seat back and head rest are included with the wheelchair, the seat back may be reclinable and pivotable between any positions intermediate a generally upright and a reclined position. The head rest, normally disposed above the seat back, may be configured to be detachable from the seat back such that it may be removed. A pair of arm rests may be included, the arm rests projecting in the lateral direction and disposed above each side of the seat base. The arm rests may be temporarily pivoted out of the way or they may be altogether removed from the seat back to further facilitate the patient transfer. The wheelchair may include the anti-tip booms disposed on either side of the support frame and they may be horizontally oriented and projecting in the forward direction The anti-tip booms may be extended in the forward direction in order to provide stability for the wheelchair against tipping such as when the weight of the patient is placed upon the security beam. The anti-tip booms may be configured to project into one of the opposing lateral directions in order to prevent tipping of the wheelchair when the patient is transferring into and out of the side of the wheelchair. The anti-tip booms may include caster wheels mounted on the end of the anti-tip booms that are held a few inches above the floor when the anti-tip booms are retracted but are placed into contact with the floor once the anti-tip booms are extended.

In operation, the wheelchair functions as a conventional wheelchair once the patient is seated therein. However, the wheelchair advantageously includes the additional combined features of the selectively moveable seat base and the security beams for allowing the patient to transfer from an article of furniture to the wheelchair, or vice versa, utilizing the force of gravity. For example, during a transfer of the patient from a bed to the wheelchair, the wheelchair is moved adjacent the bed. The security beam is disposed in a horizontal orientation and axially extended in order that the patient may conveniently grasp the security beam prior to the transfer. The patient can then use the security beams as a portable banister or hand rail to enable use of the patient's hand, arm and upper-torso muscles.

The patient is then laterally moved toward the seat base while the force of gravity acts to simultaneously pull the patient down toward the seat base. If unable to move laterally under their own power, the patient may be assisted. The anti-tip booms may be extended to any length and may be pivoted into the forward-facing or lateral-facing directions in order to provide stability against tipping of the wheelchair as may otherwise occur during application of the patient's weight upon the security beam. The patient can then be wheeled about under their own power or with assistance in the conventional manner. Transfer of the patient out of the wheelchair and into an article of furniture, such as a living room chair, is accomplished in the reverse order as that described above for transfer of the patient into the wheelchair.

The wheelchair may also be provided in a second embodiment wherein a stretcher topping may be disposed on a storage compartment which is slidably mounted on the support frame. Advantageously, the combination storage compartment and stretcher topping of the second embodiment and the seat base of the first embodiment are each configured such that they may be interchanged with each other so that the user is provided with two options for supporting the patient. The stretcher topping of the second embodiment is comprised of the storage compartment, a seat base assembly, a reclinable seat back and a leg support. The seat base assembly includes potty capabilities for the patient due to the inclusion of a potty panel disposed underneath a forward part of the seat panel. Advantageously, the stretcher topping may be arranged in a planar, stretcher-like configuration allowing the patient to lie in a supine or prone position. In addition, the stretcher topping may be arranged in a seated configuration wherein the seat back is positioned into a reclined orientation with the leg support extending downwardly in an angled orientation from the seat base assembly. The leg support may be removed.

The storage compartment of the wheelchair of the second embodiment is laterally slidably mounted upon the support frame with the seat base assembly being mounted upon the storage compartment. By configuring the storage compartment to be laterally slidable in combination with its height adjustability between first and second levels, the stretcher topping may be positioned in any position relative to an article to or from which the patient may be transferred. The stretcher topping is configured such that it may also be laterally slid over one of the main wheels for close placement near the patient to reduce any gap that may otherwise exist between the stretcher topping and the article. Gravity may be used to assist in the transfer of the patient between the stretcher topping and the article wherein the stretcher topping may be positioned such that it is lower than the article from which the patient is to be transferred. Conversely, the stretcher topping may be positioned such that it is higher than the article to which the patient is to be transferred.

The wheelchair of the second embodiment shares a commonality with several components of the wheelchair of the first embodiment including the support frame, the two main wheels, and the pair of transit wheels. The storage compartment is mounted on the support frame with a pair of sliding mechanisms interposed between the storage compartment and the support frame. The storage compartment may include a vertically disposed divider panel to divide the storage compartment into a forward section and an aft section. The aft section may include a removable drawer for holding various items. The drawer may be slidably advanced into and withdrawn from the aft section similar to the operation of a clothes dresser drawer. The seat base assembly is comprised of a removable seat panel and a potty panel. The seat panel may be sized and configured such that it is stackable upon and removable from the similarly sized potty panel. The potty panel has an aperture formed therethrough that opens into the aft section of the storage compartment. During use of the potty panel, the seat panel is temporarily removed to expose the potty panel.

The stretcher topping includes the seat back which is configured to be reclinable such that it may be positioned at any orientation between and including generally horizontal and vertical orientations. The seat back may be folded on top of the seat base assembly in order to reduce the size of the wheelchair. Arm rests may also be included with the wheelchair and each may be removable in a manner similar to the arm rest of the first embodiment and may further be vertically and/or laterally pivotably attached to the seat back such that they may be folded down flat.

A removable leg support may be included with the stretcher topping and may be pivotable about the forward end of the seat base between and including substantially horizontal and vertical orientations similar to that described above for the seat back. The leg support may include an outwardly pivotable or foldable foot rest which may be configured such that it may fold down against the leg support to allow the patient's legs to extend outstretched on the stretcher topping. The wheelchair of the second embodiment may further include at least one security beam configured as a hand-hold to aid the patient in transfers to and from the wheelchair. The security beams may be disposed behind the seat back by plugging into a security beam socket mounted behind the seat back and interposed between the main wheels. The security beams may be configured to be pivotable between substantially vertical and horizontal orientations and may be extendable outwardly from the wheelchair.

The anti-tip booms may be included with the wheelchair to prevent tipping when the weight of the patient is concentrated on an end or side of the stretcher topping. Each one of the anti-tip booms may be substantially horizontally disposed adjacent one of the main wheels and may be configured to be axially extendable and project outwardly from the support frame. The wheelchair of the second embodiment may further include a lifting mechanism configured for selectively raising or lowering the storage compartment and, hence, the stretcher topping between the first level and the second level.

BRIEF DESCRIPTION OF THE DRAWINGS

These as well as other features of the present invention will become more apparent upon reference to the drawings wherein:

FIG. 15 is a plan view of the wheelchair of the second embodiment illustrating the feature of the storage compartment having a forward section and an aft section with a drawer that may be slidably inserted thereinto;

FIG. 16 is side elevational view of the wheelchair of the second embodiment illustrating the security beam mounted on an arm rest.

DETAILED DESCRIPTION OF THE INVENTION

Figure 1:
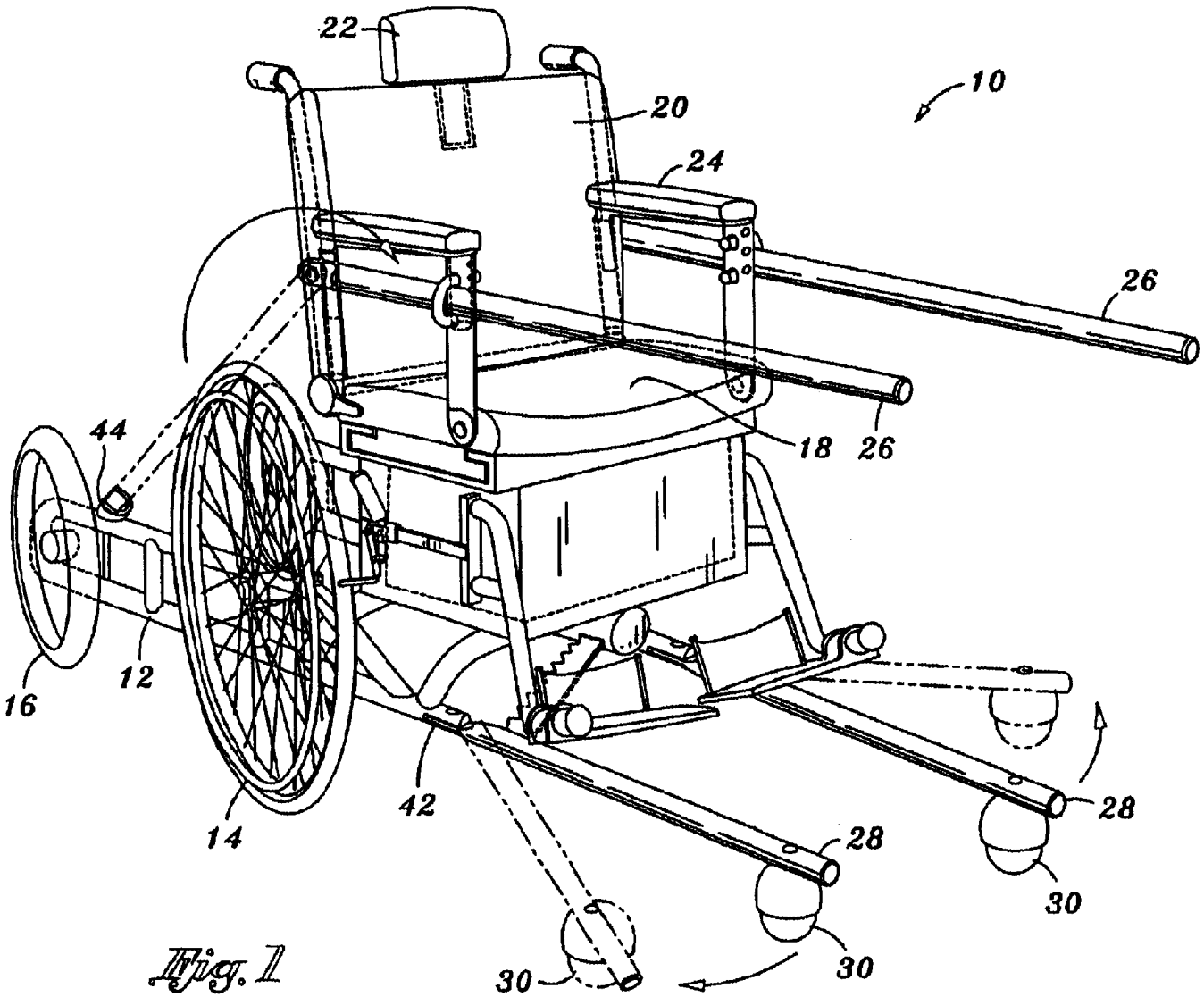
FIG. 1 is a perspective view of a wheelchair in a first embodiment of the present invention illustrating the arrangement of a pair of security beams and a pair of anti-tip booms disposed adjacent a pair of main wheels.

Referring now to the drawings wherein the showings are for purposes of illustrating preferred embodiments of the present invention and not for purposes of limiting the same, FIG. 1 is a perspective view of a wheelchair 10 in a first embodiment of the present invention. The wheelchair 10 of the first embodiment is comprised of a support frame 12 to which is attached at least two main wheels 14, a seat base 18 and at least one security beam 26. The wheelchair 10 shown in FIG. 1 comprises additional components including a pair of transit wheels 16, a pair of arm rests 24, a seat back 20 and a head rest 22. The seat base 18 is configured for selectively raising or lowering a patient between a first level 54 and a second level 56. Such selective raising and lowering may be accomplished through a lifting mechanism 32, as can be seen in FIG. 2 and in FIGS. 10 and 11.

Advantageously, as will be discussed in greater detail below, the combination of the movable seat base 18 with the at least one security beam 26 allows a patient to transfer from an article of furniture to the wheelchair 10 utilizing the force of gravity so that the patient is simultaneously moving downward and laterally while holding on to the security beam 26 during the transfer to the wheelchair 10 of the first embodiment. For example, during a transfer of the patient from a bed to the wheelchair 10, the seat base 18 is moved to the first level 54 that is at a lower level than that of the bed so that the patient is transferred to the seat base 18 in a downward motion. The patient may hold onto the security beam 26 which extends outwardly from the wheelchair 10 so that the patient may steady themselves during the transfer.

Alternately, the patient may transfer from the wheelchair 10 to a living room chair wherein the seat base 18 is moved to the second level 56 that is at a higher level than that of the living room chair. Again, gravity is utilized such that the patient is moving downward into the living room chair while the patient holds onto the security beam 26 during the transfer for additional stability. Only the application of a lateral force need be provided to perform each transfer. The lateral force may be applied solely by the patient or with assistance, such as by a caregiver. A flexible plastic sheet may be extended between the wheelchair 10 and the article of furniture so that the patient may slide across the gap therebetween. Additionally, the wheelchair 10 of the present invention may comprise a pair of anti-tip booms 28 to prevent tipping during use of the security beams 26 in patient transfers, as will be discussed in greater detail below.

Figure 2:
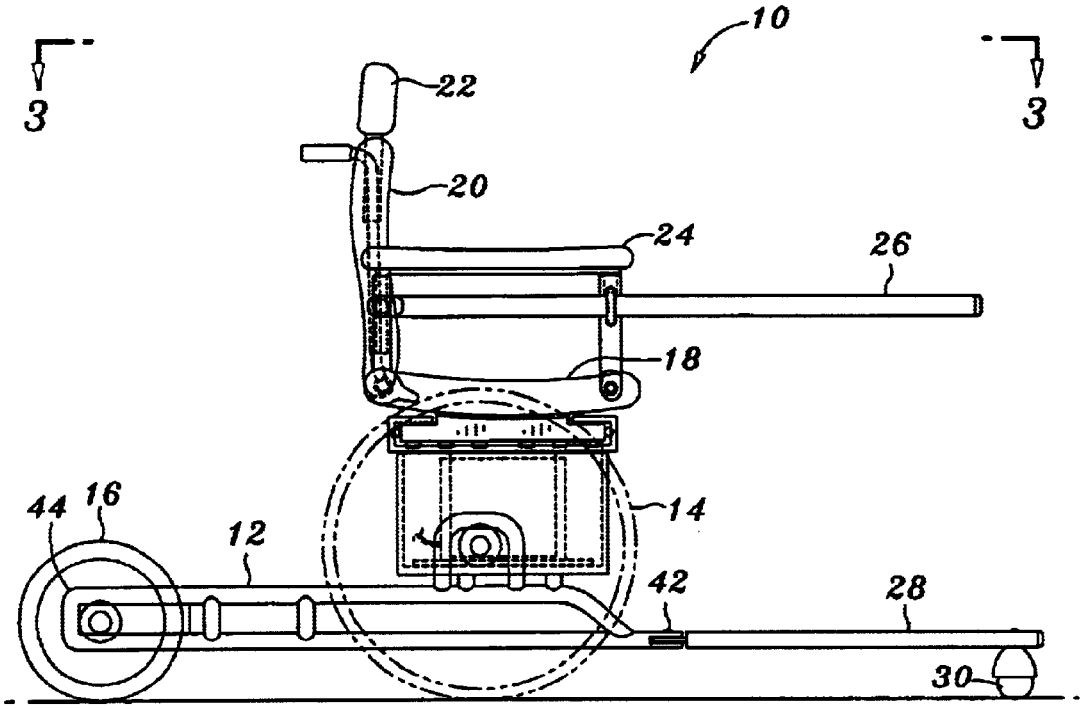
FIG. 2 is a side elevational view of the wheelchair illustrating the security beams disposed in a horizontal orientation.
Figures 10, 11:
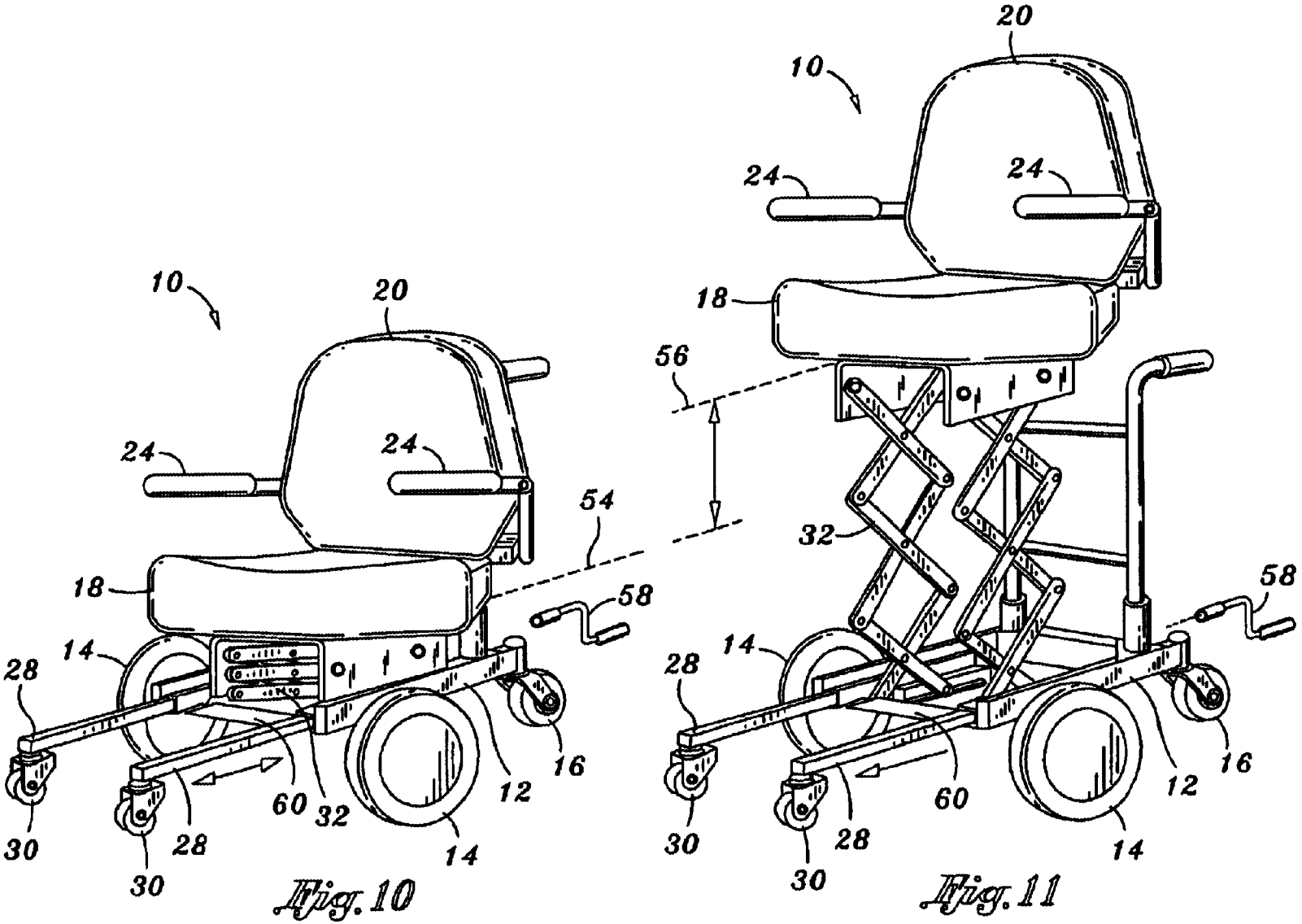
FIG. 10 is a perspective view of the wheelchair with small-diameter main wheels and illustrating the seat base lowered to a first level.
FIG. 11 is a perspective view of the wheelchair of the first embodiment illustrating the seat base raised to the second level and illustrating the lifting mechanism configured as a scissors jack.

Referring now more particularly to FIGS. 1 and 2, the wheelchair 10 of the first embodiment may include the pair of transit wheels 16 although a single transit wheel 16 may be provided. Generally smaller in diameter than the main wheels 14, the transit wheels 16 are typical of conventional wheelchairs and may be mounted to the support frame 12 such that they are free to swivel or caster about an angle perpendicular to the axis of rotation of the transit wheels 16. Alternatively, the wheelchair 10 may include relatively small diameter main wheels 14 as can be seen in FIGS. 10 and 11 such that the turning radius of the wheelchair 10 is relatively tight. Such a tight turning radius may allow a caregiver to maneuver the wheelchair 10 around obstacles and through doorways such as may exist in confined spaces of a home.

Referring back now to FIGS. 1 and 2, the transit wheels 16 may be mounted on the support frame 12 aft of the main wheels 14. Alternately, the transit wheels 16 may be mounted forward of the main wheels 14, as is the case for conventional wheelchairs. The transit wheels 16 provide lateral and forward/aft stability to the wheelchair 10 during normal operation thereof. The transit wheels 16 may also provide steering or directional control to the wheelchair 10. The anti-tip booms 28 provide lateral and forward/aft stability to the wheelchair 10 when the patient is being transferred into or out of the wheelchair 10, as will be discussed in greater detail below. It should be noted that the distance in the direction of travel from the main wheels 14 to respective ends of the anti-tip booms 28 is fairly long as compared to the relatively short distance from the main wheels 14 to the transit wheels 16.

Figure 3:
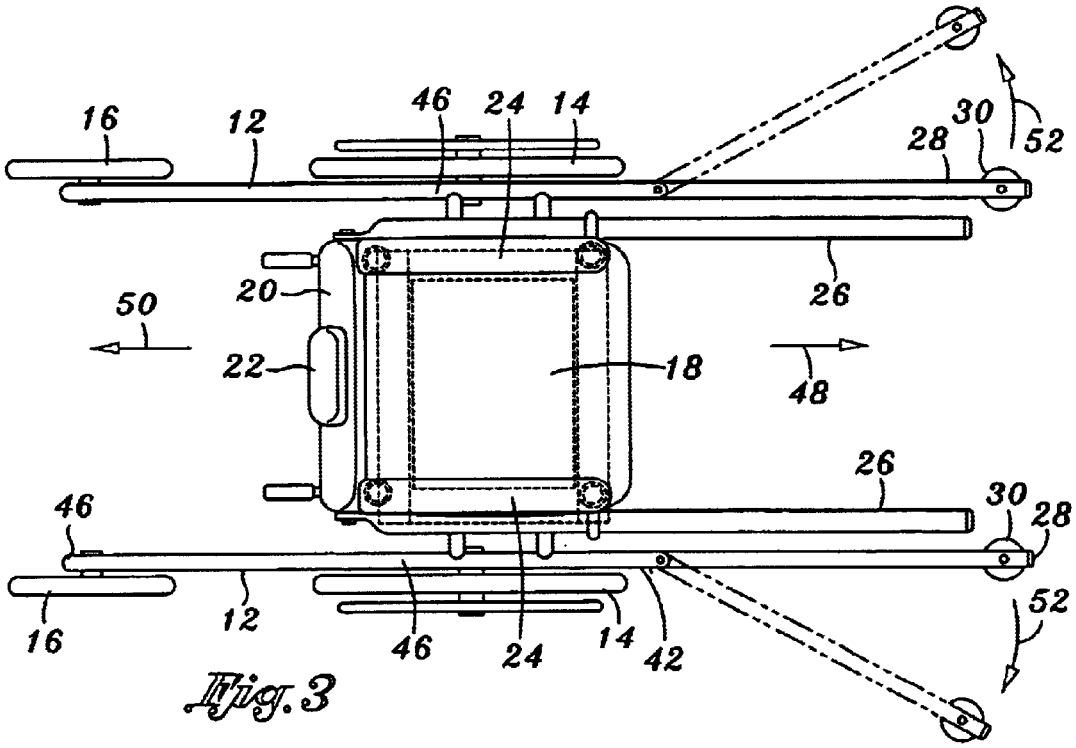
FIG. 3 is a plan view of the wheelchair taken along line 3—3 of FIG. 2 illustrating the anti-tip booms disposed in laterally outwardly projecting orientations.

Turning now to FIG. 3, shown is a plan view of the wheelchair 10 of the first embodiment taken along line 3—3 of FIG. 2 illustrating the seat base 18 disposed between the main wheels 14. The support frame 12 has a front, a rear 44, and opposing sides 46 with the front facing in a forward direction 48 and the rear 44 facing in an aft direction 50. The opposing sides 46 of the support frame 12 face in opposing lateral directions 52. The main wheels 14 are mounted on the support frame 12 and may be mounted on either side 46 of the support frame 12 as shown in FIG. 1. The main wheels 14 may be mounted coaxially although the main wheels 14 may be staggered wherein one of the main wheels 14 is disposed forward of the other one of the main wheels. It contemplated that there are many other configurations for mounting the main wheels 14. For example, a main wheel 14 may be mounted inboard of a respective side 46 of the support frame 12 such that the support frame 12 extends laterally past the main wheel 14.

Furthermore, it is contemplated that the wheelchair 10 may be configured such that a single main wheel 14 is combined with a pair of transit wheels 16 in a tricycle arrangement. In such a configuration, the single main wheel 14 may be generally disposed in front of the seat base 18 and generally in the center of the support frame 12 between the opposing sides 46. Patient transfer may also be enhanced by providing relatively small diameter main wheels 14 that have an overall height that is significantly less than the normal height of the seat base 18. The main wheels 14 may be of pneumatic construction in order to provide shock absorbing characteristics, quiet operation, and ease of rolling on rough terrain for the wheelchair 10.

The support frame 12 may be fabricated of tubing that is interconnected via any number of well-known means such as welding, with mechanical fasteners or by other means. The tubing may have a circular cross-section but may be configured with any number of cross-sectional geometries. Optionally, the support frame 12 may be fabricated of plate stock or it may be of monocoque construction. The support frame 12 may be of metallic construction such as aluminum or steel. However, any number of materials may be utilized for forming the support frame 12 such as graphite/epoxy, fiberglass, or polymeric material such as polyethylene.

Turning now to FIGS. 2 and 3, as can be seen, the seat base 18 is disposed upon the support frame 12 between the main wheels 14. The seat base 18 may be positioned such that a majority of the patient's weight is directed or biased over the main wheels 14, as can be seen if FIGS. 10 and 11. However, in the configuration described above wherein a respective main wheel 14 may be mounted between a side 46 and the midpoint of the support frame 12, each side 46 of the seat base 18 may extend along the width of the support frame 12 so that each side 46 of the seat base 18 extends past the main wheel 14.

As was mentioned above, the seat base 18 may be configured for selectively raising and lowering a patient between the first level 54 and the second level 56. FIG. 2 is a side elevational view of the wheelchair 10 of the first embodiment illustrating the seat base 18 raised to the second level 56. As can be seen, the wheelchair 10 includes a lifting mechanism 32 configured for selectively raising and lowering the seat base 18. The lifting mechanism 32 may comprise a scissors jack having linkages with the horizontal diagonals thereof being alternately lengthened and shortened by a horizontally-driven crank 58 in order to selectively raise and lower the seat base 18, as can be seen if FIGS. 10 and 11.

Optionally, the lifting mechanism 32 may comprise a pneumatic or hydraulic jack wherein compressed air or hydraulic fluid, respectively, may be alternately driven into and exhausted out of an actuator cylinder interposed between the support frame 12 and the seat base 18 in order to raise and lower the seat base 18. However, it will be recognized that the lifting mechanism 32 may be comprised of a number of alternative devices, any of which may be utilized for selectively raising and lowering the seat base 18. The lifting mechanism 32 may be configured for lowering the seat base 18 to the first level 54 such that the patient may be lifted off of the floor with the aid of the security beams 26. In such a scenario, it is contemplated that the security beams 26 may be horizontally oriented and slipped under the armpits of the patient. In this regard, the wheelchair 10 acts as a jack to lift the patient up to a height sufficient for transfer into the wheelchair 10 or into an adjacent article of furniture.

Figure 5:
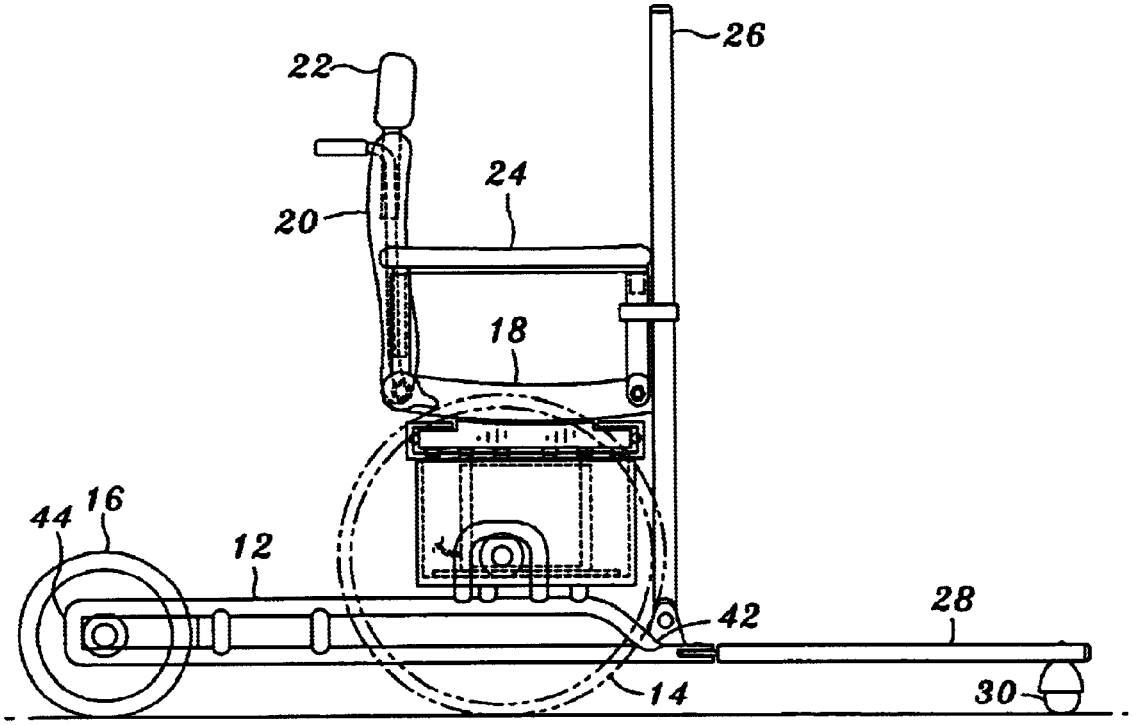
FIG. 5 is a side elevational view of the wheelchair illustrating the security beams being disposed in a vertical orientation.

Turning briefly now to FIG. 5, shown is a side elevational view of the seat base 18 illustrating a sliding mechanism for translating the seat base 18 in the lateral direction 52. The seat base 18 may be configured to be relatively wide such that the seat base 18 extends over the wheels when the seat base 18 is moved laterally. Such a wide seat base 18 may help to bridge the gap between articles of furniture and the like. In this regard, the relatively wide seat base 18 may simplify patient transfers.

The seat base 18 may be configured to be selectively translatable in the lateral direction 52 wherein the seat base 18 may be slidably mounted upon the support frame 12. In a preferred embodiment, the seat base 18 is configured to translate six inches in a lateral direction 52 from a neutral or central position. Additionally, the seat base 18 may also be configured to translate six inches in an opposite lateral direction 52. However, it will be recognized that the seat base 18 may be configured to translate over any distance in either of the opposing lateral directions 52.

A locking feature may be incorporated into the wheelchair 10 of the first embodiment to selectively lock the seat base 18 into a neutral or centered position. The locking mechanism may also be utilized to lock the seat base 18 into either one of the lateral positions, including any intermediate position, in order to restrict lateral movement of the seat base 18 during a transfer operation. Also, the seat base 18 may be configured to be pivotable about a vertical axis to aid in the transfer of the patient into and out of the wheelchair 10. The pivot point may be located generally near a center position of the seat base 18. However, the seat base 18 may be configured to be pivotable about any point on the wheelchair 10, such as near a corner of the seat base 18 perimeter.

Referring back to FIG. 1, shown is the pair of security beams 26 having substantially horizontal orientations and projecting outwardly in the forward direction 48 although it is contemplated that only the single security beam 26 may be provided with the wheelchair 10. As can be seen, a security beam 26 is disposed adjacent each of the main wheels 14. The security beams 26 may have a substantially vertical orientation. As was earlier mentioned, the security beams 26 are configured as hand holds for the patient when transferring onto and off of the seat base 18. In this regard, it is contemplated that the security beams 26 may be configured as an elongate member of cylindrical cross-section, at least in the area where the patient may hold onto the security beam 26. In consideration of the desire to provide a hand hold that may be easily grasped by the human hand, a diameter of one to one and one-half inches may be a preferred size for the security beam 26.

A preferred length of the security beams 26 may be forty inches in order to provide a length sufficiently extending past the wheelchair 10 such that a patient sitting on an adjacent article of furniture may easily grasp the security beam 26 prior to transferring into the wheelchair 10. However, it is contemplated that there are many shapes, sizes and configurations for the security beam 26 that may be workable. Shown in FIGS. 1 and 2 as being disposed adjacent the arm rests 24, the security beams 26 may be connected thereto by any conventional means such as with fittings and mechanical fasteners.

The security beams 26 may also be connected to the support frame 12 via vertical members that place the security beam 26 at approximately the same height as the arm rests 24. Furthermore, the security beam 26 may be configured to be selectively raised and lowered either independently, or in conjunction with the seat base 18, as an additional feature which may increase the flexibility of the manner in which the patient transfer may be performed. The security beams 26 may be attached to arm rests 24 that may be included with the wheelchair 10 of the first embodiment. In addition, the security beams 26 may be attached to a security beam socket 86 disposed on a back side of the seat back 20. The security beam socket 86 may be seen in FIGS. 12, 16 and 17.

The security beams 26 may be configured to be axially extendable such that the overall length of the security beams 26 may be extended beyond an initial length. In this regard, the security beams 26 may be comprised of slidable, coaxial sleeves configured to telescope outwardly. The sleeves may be manually extended outwardly to a desired length. A locking collar may be provided at the end of each sleeve to lock the individual sleeves in position once the security beam 26 is extended to the desired position. The security beam 26 may be configured to be pivotable between the substantially vertical orientation and the substantially horizontal orientation and may be completely detachable from the wheelchair 10. The security beams 26 may be locked in either of the orientations by means of locking pins.

Additionally, it is contemplated that the security beams 26 may be pivoted and locked into any position intermediate the substantially vertical orientation and the substantially horizontal orientation such as by means of a spring-loaded, notched fitting located at the pivot joint. In the horizontal orientation, the security beam 26 may be fitted with fittings that mate with sockets disposed, for example, on a bathroom wall near a toilet or a shower. The security beams 26 may be placed in the mating sockets to provide temporary banisters or railings to support the patient as they transfer from the wheelchair 10 to the toilet or shower. The security beams 26 may also be configured to be removable in order to increase the compactness and reduce the weight of the wheelchair 10 to enhance its storability and to make it more convenient to transport, such as in an automobile or van.

Figure 6:
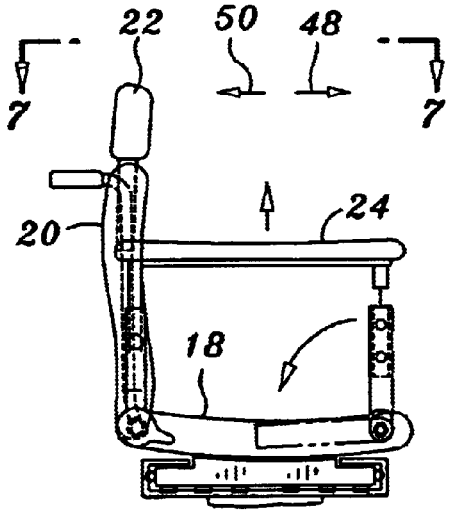
FIG. 6 is a partial side elevational view of the wheelchair illustrating arm rests of the wheelchair being raised upwardly such that they may be pivoted laterally outwardly.

Turning now to FIG. 6, shown is the wheelchair 10 of the first embodiment comprising the seat back 20 and the head rest 22. The seat back 20 may be reclinable and pivotable between generally upright and reclined positions about an aft end of the seat base 18. In the upright position, the seat back 20 may be disposed in an orientation similar to that of the seat back 20 of a living room chair. In the reclined position, the seat back 20 may be disposed in a substantially horizontal orientation wherein the seat back 20 is substantially parallel with the seat base 18 such that the occupant is lying flat. Furthermore, the seat back 20 may be pivoted and locked into any position intermediate the generally upright and reclined positions. For example, the seat back 20 may be reclined to a position approximately midway between the upright and reclined positions so that the patient's hair may be washed in a hair washing basin at a hair salon. The head rest 22, normally disposed above the seat back 20, may be configured to be detachable from the seat back 20 such that it may be removed to avoid interference with the washing basin.

Figure 4:
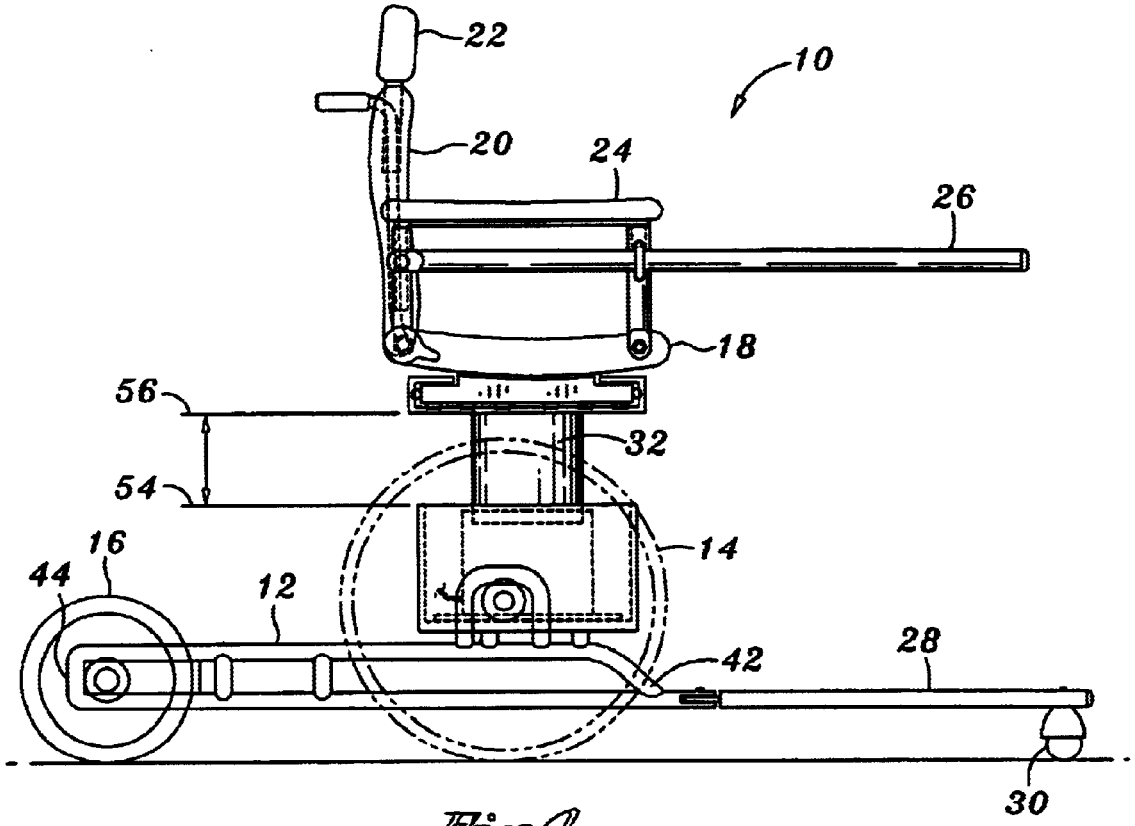
FIG. 4 is plan view of the wheelchair illustrating the security beams projecting outwardly in a horizontal orientation with the seat base of the wheelchair being raised to a second level.

Referring to FIG. 4, shown is a plan view of the wheelchair 10 illustrating the pair of arm rests 24 projecting in the lateral direction 52. As was mentioned above, the arm rests 24 may be configured to be horizontally pivotable. A respective one of the arms rests 24 may be disposed above each side 46 of the seat base 18. A clevis and pin arrangement may be included between a respective one of the arm rests 24 and the seat back 20 at the intersection thereof to provide the pivoting feature of the arm rests 24. In the scenario described above wherein the head rest 22 may be temporarily removed from the reclined seat back 20 to facilitate washing of the patient's hair in a washing basin, the arm rest 24 may also be temporarily pivoted out of the way or altogether removed from the seat back 20 to further facilitate such an activity. It is contemplated that the seat back 20 itself may be removable to reduce the overall height of the wheelchair 10 in order to make it more convenient to transport. In this regard, the seat base 18 itself may further be configured to be removable from the wheelchair 10 in order to provide an additional measure of compactness.

Referring briefly now to FIGS. 2 and 3, shown is a plan view of the wheelchair 10 of the first embodiment illustrating the anti-tip booms 28 being substantially horizontally disposed and projecting in the forward direction 48 adjacent the main wheels 14. As was mentioned earlier, the anti-tip booms 28, when extended in the forward direction 48, provide stability for the wheelchair 10 in the forward direction 48 against tipping such as when the patient places their weight upon the security beam. Such additional stability may be required beyond that which is provided by the combination of the main wheels 14 with the transit wheels 16. The anti-tip booms 28 may be configured to react any downward force that is placed thereupon by the patient. In order to provide additional stability for the wheelchair 10 in the lateral direction 52, a respective one of the anti-tip booms 28 may be configured to project in one of the opposing lateral directions 52. Such an orientation of the anti-tip booms 28 may be desirable when the patient is transferring into and out of the side 46 of the wheelchair 10.

The lateral orientation of the anti-tip booms 28 may further be desirable when the seat base 18 is translated laterally or pivoted and the arm rests 24 are also pivoted or removed for simplifying the transfer of the patient into and out of the side 46 of the wheelchair 10. The anti-tip booms 28 may be configured to be pivotable and locked into any position that is intermediate the forward-projecting orientation and the laterally-projecting orientation. Similar to the above-described telescoping arrangement of the security beams 26, the anti-tip booms 28 may be likewise comprised of telescoping, coaxial sleeves that may be manually extended to a desired length and locked into place via pins or a locking collar. The anti-tip booms 28 may include caster wheels 30, skids, suction cups and the like on the extreme end of each anti-tip boom 28. However, any number of devices may be incorporated into the respective ends of the anti-tip booms 28. The anti-tip booms 28 may be configured such that the caster wheels 30, skids, or alternative devices mounted on the end of the anti-tip booms 28 are fixed a few inches above the floor when the anti-tip booms 28 are retracted, but are placed in contacting relation with the floor once the anti-tip booms 28 are extended.

Figure 7:
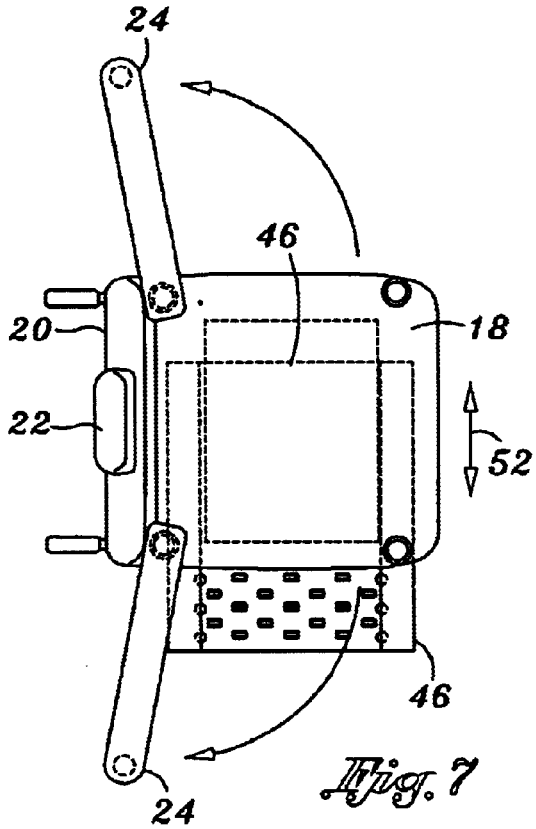
FIG. 7 is a partial plan view of the wheelchair illustrating the seat base being disposed laterally over a main wheel with the arm rests being disposed in an outwardly pivoted orientation.
Figure 8:
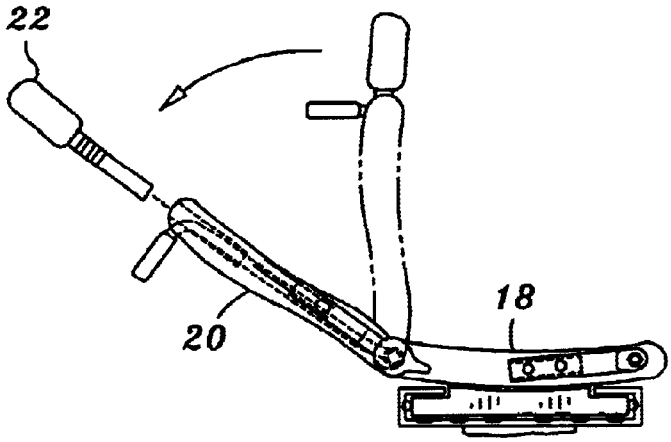
FIG. 8 is a partial side elevational view of the wheelchair illustrating a seat back of the wheelchair being pivoted into a reclining orientation.
Figure 9:
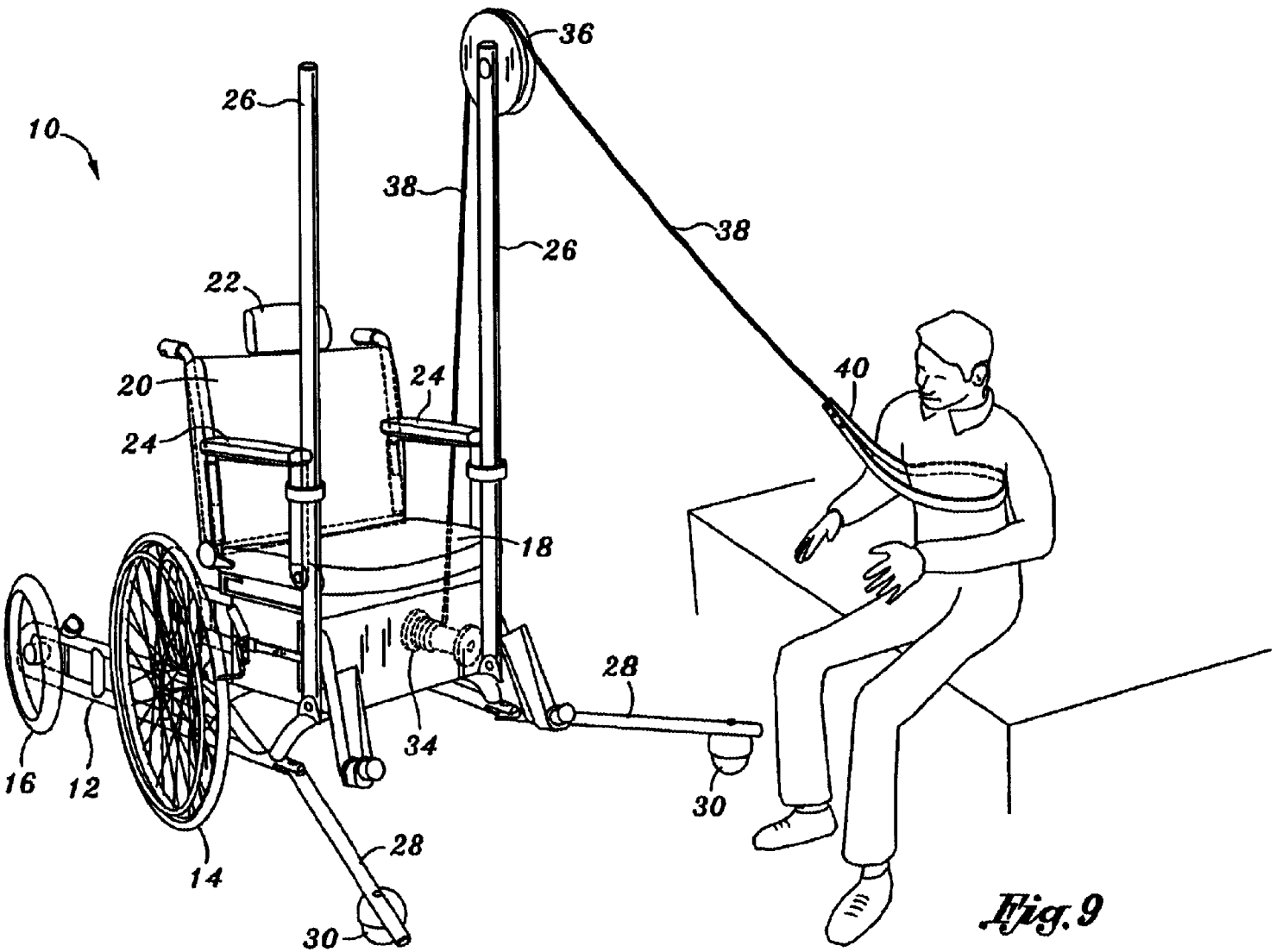
FIG. 9 is a perspective view of the wheelchair illustrating a winch motor, a winch pulley mounted on the security beam, and a winch cable connected to a patient via a body harness for raising and lowering the patient.

Referring now to FIG. 7, shown is a perspective view of the wheelchair 10 further comprising a winch motor 34 and a winch pulley 36 mounted on the vertically-disposed security beam 26. A winch cable 38 may be connected to the patient via a shoulder harness or a body harness 40. Rotation of the winch motor 34 causes the winch cable 38 to alternately raise and lower the patient. The winch pulley 36, although shown as being disposed on an end of the security beam, may be configured to be removable therefrom. Also, the winch pulley 36 may be disposed anywhere along a length of the security beam 26 although shown in FIG. 7 as being disposed on an end thereof.

The shoulder or body harness 40 may be padded in order to provide cushioning to the patient. The patient may be raised or lowered by operating the winch motor 34 to alternately retract or extend the winch cable 38. It is contemplated that the winch motor 34 may be utilized to raise the patient, such as from a supine position on a bed, to a sitting position, prior to initiation of the transfer of the patient from the bed to the wheelchair 10. It is contemplated that the winch motor 34 may be electrically powered such as by a battery, which may be disposed on the support frame 12 under the seat base 18.

In this regard, it is further contemplated that the wheelchair 10 of the first embodiment may further comprise a motor mounted on the support frame 12. The motor may be configured for driving the main wheels 14 in order to propel the wheelchair 10. Additionally, the motor may be configured for raising and lowering the seat base 18. Other features that may be powered by the motor include the reclining of the seat back 20, pivoting of the arm rests 24 and anti-tip booms 28, and axial extension of the anti-tip booms 28. The pivoting and the axial extension of the security beams 26 may also be actuated by the motor wherein the power may be provided by the battery which may be mounted adjacent the motor on the support frame 12 so as to maintain a low center of gravity. Additionally, the seat base 18, seat back 20, arm rests 24 and head rest 22 may be combined into a single powered seating unit similar to powered seats utilized in many automobiles.

Referring now to FIGS. 10 and 11, shown is the wheelchair 10 with main wheels 14 that are of a smaller diameter than that illustrated in FIGS. 1 through 8. As was mentioned above, the smaller diameter main wheels 14 provide a tighter turning radius to allow a caregiver to more easily maneuver the wheelchair 10 around obstacles and through doorways in the confined spaces of a home. Patient transfers may also be enhanced by providing relatively small diameter wheels that have an overall height that is significantly less than the normal height of the seat base 18 such that the seat base 18 may be laterally extended over the wheels in order to minimize the gap between the wheelchair 10 and the article to which the patient is to be transferred. By configuring the wheelchair 10 with a relatively wide seat base 18, the seat base 18 may be moved closer to the article of furniture, thus reducing the gap therebetween. A flexible plastic sheet may be utilized to assist the caregiver in transferring the patient across the gap such that the patient will not accidentally fall between the gap, as will be discussed in more detail below.

In FIG. 10, the wheelchair 10 of the first embodiment is shown with the seat base 18 being lowered to the first level 54. In FIG. 11, the seat base 18 is shown being raised to the second level 56. The lifting mechanism 32 illustrated in FIGS. 10 and 11 is a scissors jack configuration operated by the crank 58 in the manner previously described for the first embodiment. The arm rests 24 and the seat back 20 are configured to move upwardly and downwardly with the seat base 18 so as to allow the patient to steady themselves with the arm rests 24 and security booms during transfers. As can also be seen in FIGS. 10 and 11, the anti-tip booms 28 may be extended to prevent the wheelchair 10 from tipping over when the weight of the patient is extended over the main wheels 14. Caster wheels 30 may be provided on ends of the anti-tip booms 28 to allow the wheelchair 10 to be maneuvered during transfer operations.

A footrest 60 or a pair of footrests 60 may be included in the wheelchair 10 of the first embodiment. One configuration of the footrest 60 may be seen in FIGS. 10 and 11 disposed forward of the scissors jack near the anti-tip booms 28. The footrest 60 may be configured such that the patient may stand on the footrest 60 with the anti-tip booms 28 extended during transfers. The footrest 60 may also be provided in the wheelchair 10 configurations shown in FIGS. 1 through 8. It is contemplated that the wheelchair 10 of the first embodiment shown in FIGS. 10 and 11 may also be provided in an electric version wherein the motor for propelling the wheelchair 10 may be mounted under the seat base 18 adjacent batteries in a manner similar to that described above for the wheelchair 10 configurations of FIGS. 1 through 8. The security beams 26 may also be provided in the wheelchair 10 of FIGS. 10 and 11.

The operation of the wheelchair 10 of the first embodiment will now be discussed. Although operable in the conventional manner when transporting a seated occupant, the wheelchair 10 advantageously includes the additional combined features of the selectively moveable seat base 18 with the at least one security beam 26 for transferring the patient into and out of the seat base 18. Importantly, as was mentioned earlier, the present invention allows the patient to transfer from an article of furniture to the wheelchair 10, utilizing the force of gravity so that the patient is moving simultaneously downward and laterally while holding onto the security beam 26 during the transfer to the wheelchair 10. For example, during a transfer of the patient from a bed to the wheelchair 10, the wheelchair 10 is moved adjacent the bed and positioned thereagainst in side-by-side arrangement.

If so equipped, brakes for the main wheels 14 may be engaged to restrict movement thereof. If included, the arm rest 24 nearest the bed may be pivoted from its normal forward facing direction to a lateral direction 52 so that it does not block lateral movement of the patient. The security beam 26 may then be attached to the wheelchair 10 and moved to a vertical orientation. If permanently affixed to the wheelchair 10, the security beam 26 may be axially extended in order that the patient may conveniently grasp the security beam 26 prior to the transfer. Optionally, the security beam 26 may be installed in the horizontal orientation and may be axially extended so that it rests on the bed.

The patient can then use the security beam 26 as a portable banister or hand rail to enable use of the patient's hand, arm and upper-torso muscles to aid in the transfer. If a pair of security beams 26 is provided, the pair of security beams 26 may be placed parallel to each other on the bed straddling the seated patient. Such an arrangement may enable the patient to walk their hands along the security beams 26 during a transfer. The anti-tip booms 28 may be extended to any length and may be pivoted into the forward facing or lateral directions 52 as required in order to provide stability against tipping of the wheelchair 10 as may otherwise occur during application of the patient's weight upon the security beam 26.

The anti-tip booms 28 act as a brace to prevent the wheelchair 10 from tipping over when weight is placed on the security beams 26 ahead of the chair or to the wheelchair 10 side 46. The seat base 18 may be laterally translated over the main wheels 14 nearer to the bed to decrease the distance over which the patient must be transferred. A flexible plastic sheet may be utilized as a transfer aid to slide the patient across the gap between the wheelchair 10 and the bed. The flexible plastic sheet may also span any differential in height between the wheelchair 10 and the bed. Preferably, the wheelchair 10 may be raised to the second level 56 such that the seat base 18 is higher than the bed. By using a flexible plastic sheet, the patient may then be slid slightly downwardly across the gap on the flexible plastic sheet from the seat base 18 to the bed.

Additionally, if so configured, the seat base 18 may be pivoted to simplify the transfer. The seat base 18 is moved to the first level 54 that is at a lower level than that of the bed so that the patient is transferred from the bed down to the seat base 18. In this regard, a motorized bed that may be raised above the level of the seat base 18 may be advantageously utilized. Furthermore, the motorized bed may be utilized to raise the patient from a prone or supine position, where the patient is laying horizontally on the bed, up to a more upright sitting position. If the patient is unable to move from a supine position to a sitting position, either acting alone or with assistance, the combination of the winch motor 34, winch pulley 36, winch cable 38 and body harness 40 may be employed to lift the patient. The winch motor 34 may be engaged in order to retract the winch cable 38 and thereby raise the patient to a sitting position.

Once in the sitting position, the patient may grab one or both of the security beams 26 to maintain balance and stability during the transfer. If capable, the patient may stand, utilizing the security bars for support. The patient is then laterally moved toward the seat base 18 while the force of gravity acts to simultaneously pull the patient down toward the seat base 18. Here again, the flexible plastic sheet may be utilized to allow the patient to slide across the gap between the wheelchair 10 and the bed. If unable to move laterally under their own power, the patient may be assisted. Once the patient is positioned upon the seat base 18, the body harness 40 may be removed and the winch cable 38 stowed. The anti-tip booms 28 and security beams 26 may be retracted and the arm rest 24 returned to their normal positions. The patient can then be wheeled about in the wheelchair 10 under their own power or with the assistance of a caregiver.

Transfer of the patient out of the wheelchair 10 and into an article of furniture, such as a living room chair, is accomplished in the reverse order as that described above. A typical sequence of operations when transferring a patient out of the wheelchair 10 may start with positioning the wheelchair 10 adjacent the article to which the patient is to be transferred. The main wheels 14 may be locked to prevent movement of the wheelchair 10. The security beams 26 and anti-tip booms 28 may then be oriented in a forward direction 48, laterally or in any intermediate orientation.

If so configured, the anti-tip boom 28 may then be extended to the desired length and locked into place. The seat base 18 is raised above the level of the article to which the patient is transferred. Arm rests 24 may be pivoted out of the way or removed. The winch motor 34 may be utilized to assist the patient in rising to a standing position if the patient is incapable of supporting their own weight. The patient is then laterally moved to the article of furniture utilizing the force of gravity to assist in the transfer. After the transfer, the anti-tip booms 28 and security beams 26 may be retracted and the body harness 40 removed.

During the transfer, the patient may grasp the security beam 26 which extends outwardly from the wheelchair 10 so that the patient may steady themselves and maintain their balance. Alternately, the patient may transfer from the wheelchair 10 to a living room chair wherein the seat base 18 is moved to the second level 56 that is at a higher level than that of the article of furniture. Again, gravity is utilized such that the patient is moving downward into the living room chair while the patient holds onto the security beam 26 during the transfer for additional stability. Only the application of a lateral force need be provided to perform each transfer. The lateral force may be applied solely by the patient or with assistance, such as by a caregiver.

As was earlier mentioned, the security beams 26 may also be utilized in raising the patient up off of the floor by slipping the security beams 26 underneath the armpits of the patient. Furthermore, it is contemplated that the wheelchair 10 of the present invention may be utilized to perform patient transfer between many other articles including a shower and an automobile seat.

Referring now to FIGS. 12–17, the wheelchair 10 may also be provided in a second embodiment wherein a stretcher topping 62 may be disposed on a storage compartment 64 which is slidably mounted on the support frame 12. Advantageously, the combination storage compartment 64 and stretcher topping 62 of the second embodiment and the seat base 16 of the first embodiment are each configured such that they may be interchanged with each other. In this manner, the user is provided with two options for supporting the patient.

Figure 12:
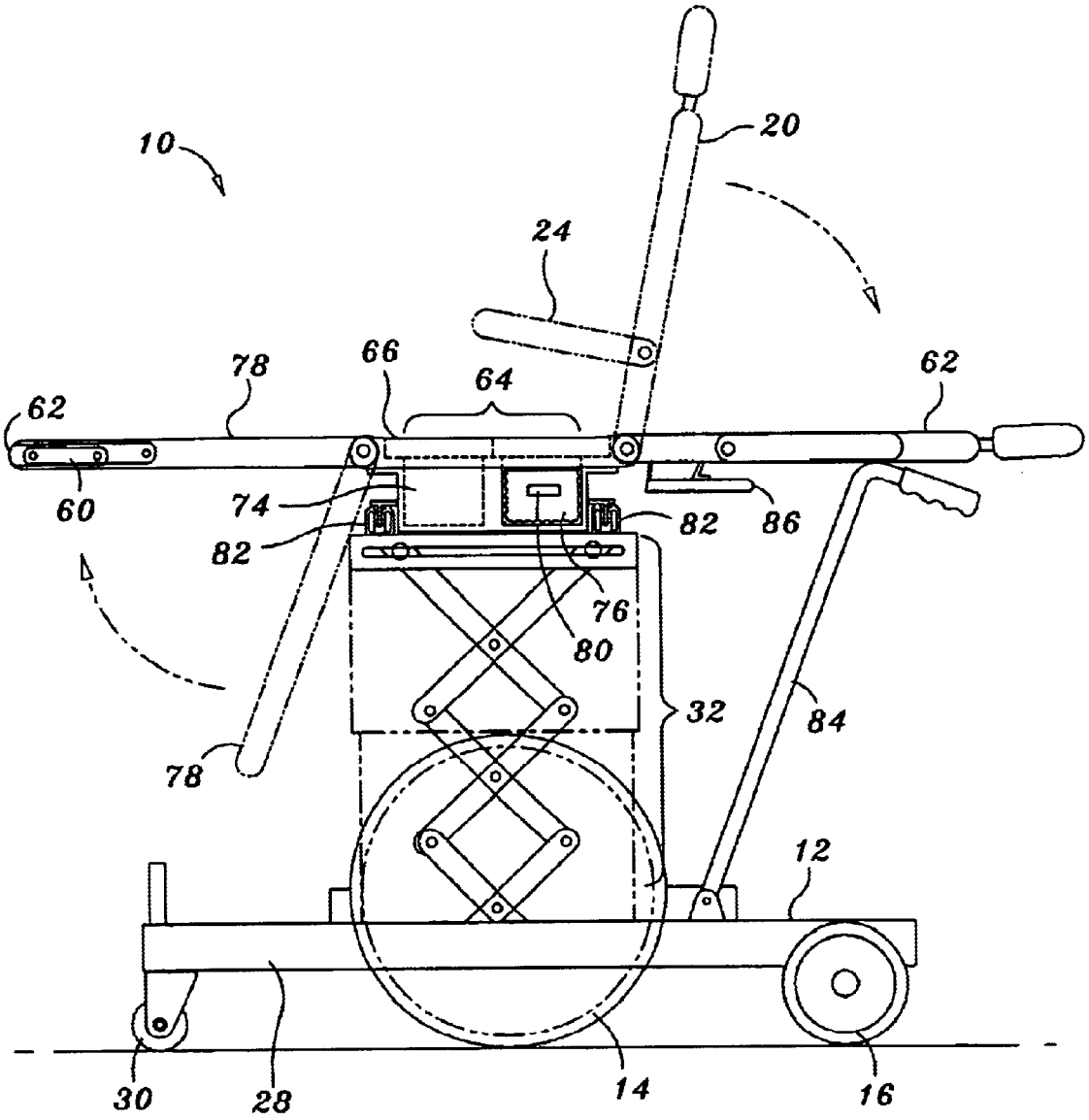
FIG. 12 is a side elevational view of the wheelchair in a second embodiment having a stretcher topping mounted upon a laterally slidable storage compartment.

The stretcher topping 62 of the second embodiment is comprised of the storage compartment 64, a seat base assembly 66, a reclinable seat back 20 and a leg support 78, as is shown in FIG. 12. The seat base assembly 66 includes potty capabilities for the patient due to the inclusion of a potty panel 70 disposed underneath a part of the seat panel 68. Advantageously, the stretcher topping 62 may be arranged in a planar, stretcher-like configuration as shown in FIG. 12 by horizontally aligning the seat back 20 and the leg support 78 with the seat base assembly 66. In the stretcher-like configuration, the stretcher topping 62 allows the patient to lie in a supine or prone position.

The seat base assembly 66 is mounted upon the storage compartment 64, which in turn is mounted on the support frame 12 in such a manner that the patient's weight may be supported without propping up either one of the leg support 78 or the seat back 20 thereof. However, a push handle 84 may be provided under the seat back 20 if so desired in order to provide additional support for the seat back 20 when additional weight is placed thereupon such as may occur when the patient is using the potty panel 70, as will be described in greater detail below.

In addition, the stretcher topping 62 may be arranged in a seated configuration wherein the seat back 20 is positioned into a reclined orientation with the leg support 78 extending downwardly in an angled orientation from the seat base assembly 66. The leg support 78 may be removed to enable lateral sliding of the stretcher topping 62 without the leg support 78 interfering with the main wheels 14. As will be appreciated, the stretcher topping 62 may be arranged in an infinite number of configurations due to the capability of the seat back 20 and the leg support 78 to be positioned in any orientation between and including the substantially horizontal orientation and the vertical orientation. Furthermore, the seat back 20 is configured such that it may be folded on top of the seat base assembly 66 to reduce the size of the stretcher topping 62. The leg support 78 is configured to be completely removable in order to enhance the storage and transportability of the wheelchair 10.

Importantly, the storage compartment 64 of the wheelchair 10 of the second embodiment is laterally slidably mounted upon the support frame 12 with the seat base assembly 66 being mounted upon the storage compartment 64. By configuring the storage compartment 64 to be laterally slidable in combination with its height adjustability between first and second levels 54, 56, the stretcher topping 62 may be positioned in any position relative to an article to or from which the patient may be transferred. More specifically, the wheelchair 10 is configured such that the stretcher topping 62 may be raised or lowered until it is positioned at a level that is slightly lower or higher than that of an article, such as a bed, to which or from which the patient may be transferred. The stretcher topping 62 is configured such that it may also be laterally slid over one of the main wheels 14 for close placement near the patient.

By positioning the stretcher topping 62 close to the patient, any gap that may otherwise exist between the stretcher topping 62 and the article may be minimized or altogether eliminated. With the gap eliminated between the stretcher topping 62 and the auricle, the patient may be easily rolled or slid from the bed onto the stretcher topping 62, as will be explained in greater detail below. Gravity may be used to assist in the transfer of the patient between the stretcher topping 62 and the article. In each case, the stretcher topping 62 may preferably, but optionally, be positioned such that it is lower than the article from which the patient is to be transferred. Conversely, the stretcher topping 62 may be positioned such that it is higher than the article to which the patient is to be transferred.

Referring to FIG. 12, shown is a side view of the wheelchair 10 of the second embodiment showing the stretcher topping 62 mounted upon the laterally slidable storage compartment 64. The wheelchair 10 of the second embodiment shares a commonality with several components of the wheelchair 10 of the first embodiment. In this regard, the wheelchair 10 of the second embodiment is comprised of the support frame 12 having the front 42, the rear 44 and the opposing sides 46. The support frame 12 may be configured in a manner as described above for the first embodiment. The front 42 and the rear 44 of the support frame 12 face in respective forward and aft directions 48, 50 with the opposing sides 46 facing in opposing lateral directions 52. The support frame 12 may be fabricated from any material or combination of materials as described above in the support frame 12 of the first embodiment.

The two main wheels 14 are mounted on the support frame 12 wherein a respective one of the main wheels 14 is mounted adjacent a respective one of the opposing sides 46 in a manner similar to that shown in FIG. 15. However, it is contemplated that the main wheels 14 may be provided in any quantity and may be mounted in any number of locations on the support frame 12, as was also mentioned above in the description of the first embodiment. It should be noted that the main wheels 14 of the second embodiment may be of a smaller size than the main wheels 14 of the first embodiment in order to provide clearance for the stretcher topping 62 so that it may be slid over either one of the main wheels 14 without regard to height setting of the stretcher topping 62 (i.e., whether it is placed at the first level 54 or at the second level 56).

The pair of transit wheels 16 may be included with the wheelchair 10 and may be mounted on the support frame 12 forward or aft of the main wheels 14. The transit wheels 16 are configured to add stability to the wheelchair 10 in a manner similar to that shown in FIGS. 1 and 15. However, only a single one of the transit wheels 16 may be included or multiple transit wheels 16 may be included with the wheelchair 10 of the second embodiment. In a manner similar to that shown and described above for the first embodiment, the transit wheels 16 may be mounted on the support frame 12 aft of the main wheels 14. Alternately, the transit wheels 16 may be mounted forward of the main wheels 14, as is the case for conventional wheelchair 105. The transit wheels 16 provide lateral and forward/aft stability to the wheelchair 10 during normal operation thereof. The transit wheels 16 may also provide steering or directional control to the wheelchair 10.

Figure 14:
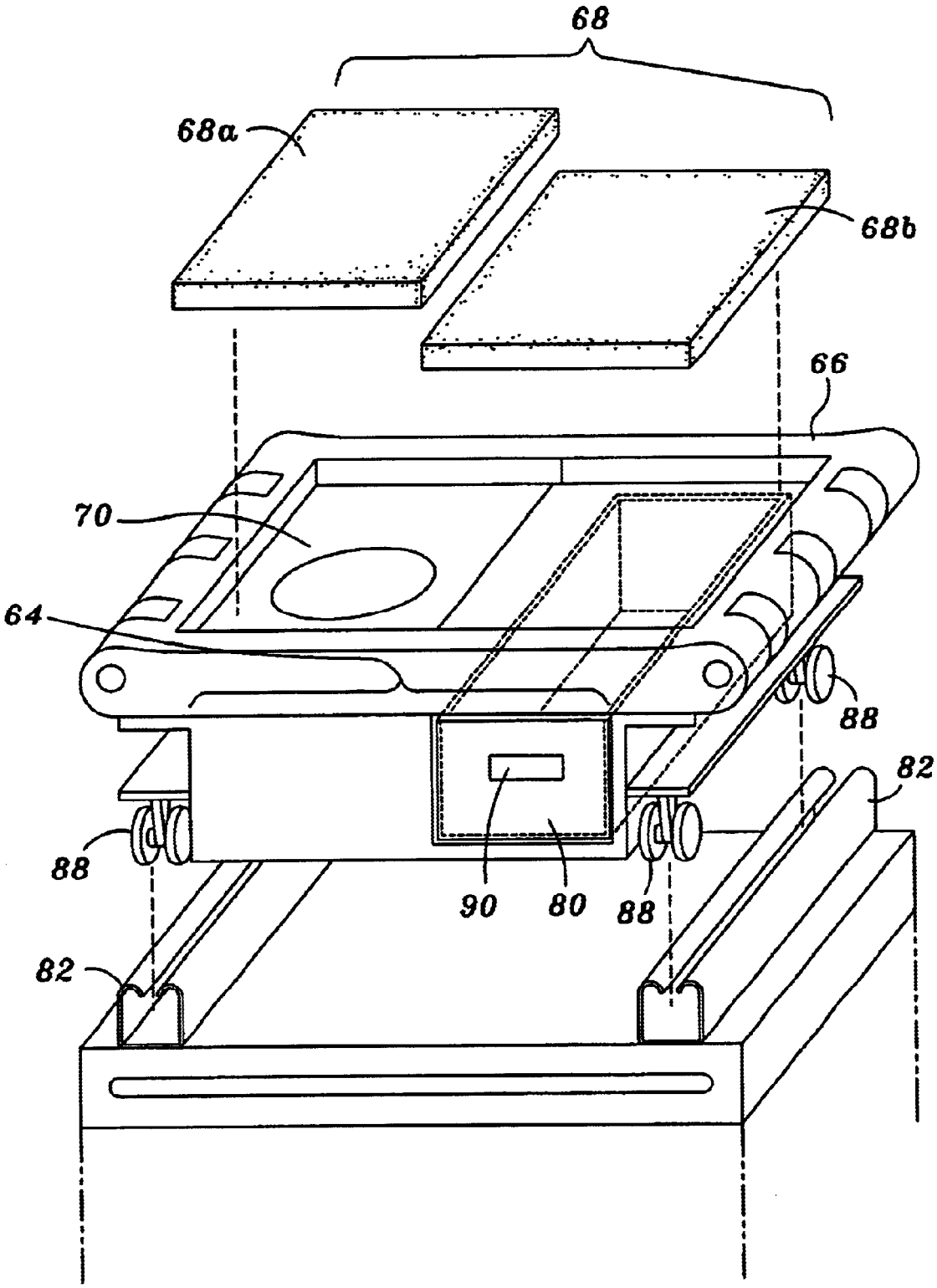
FIG. 14 is a exploded partial perspective view of the seat base assembly and the laterally slidable storage compartment mountable on a pair of sliding mechanisms.

Referring now to FIGS. 14 and 16, shown is the laterally sliding storage compartment 64 mounted on the support frame 12. A pair of sliding mechanisms 82, shown in 14, may be interposed between the storage compartment 64 and the support frame 12. Each one of the sliding mechanisms 82 may preferably, but optionally, consist of a generally U-shaped channel that may be affixed to the support frame 12. Each one of U-shaped channels may be comprised of a pair of upwardly extending flanges with an upper edge of each flange having a down turned flange, as is shown in FIG. 14. Each one of the U-shaped channels may be sized and positioned to extend across a width of the support frame 12. The sliding mechanism 82 may be fabricated from any type of material such as, for example, metal or plastic such as polyethylene plastic.

A complementary set of rollers 88 may be affixed to a front wall as well as to a rear wall of the storage compartment 64. The rollers 88 may be sized and configured to match an inner geometry of each of the U-shaped channels such that the rollers 88 may be contained within the confines of the channels. Stops may be included on opposing ends of each one of the U-shaped channels in order to prevent the rollers 88 from rolling out of either one of the ends of the U-shaped channel when the storage compartment 64 is laterally moved via the sliding mechanism 82.

Each one of the rollers 88 may be secured to the front and rear walls of the storage compartment 64. Alternatively, a T-shaped extrusion may be fastened to each one of the front and rear walls of the storage compartment 64, as can be seen in FIG. 14. Each one of the rollers 88 may be attached to opposing ends of each one of the T-shaped extrusions. Although the sliding mechanism 82 is shown and described as comprising the pair of U-shaped channels, sets of rollers 88, and T-shaped extrusions, it is contemplated that the sliding mechanism 82 may be comprised of a variety of alternate components and may be arranged in any configuration that provides the feature of lateral slidability of the storage compartment 64 and, hence, the stretcher topping 62.

The storage compartment 64 may be comprised of a bottom panel, a pair of side walls, and the front and rear walls mentioned above. Each one of the side walls and front and rear walls may extend upwardly from the bottom panel to the seat base assembly 66. Although shown as being generally rectangularly shaped, the storage compartment 64 may be configured in any number of shapes such as a rounded shape. However, the generally rectangular shape is believed to be advantageous in that the storage compartment 64 may generally match a preferred rectangular shape of the seat base assembly 66.

In this manner, the side walls and front and rear walls of the storage compartment 64 may be readily fastened to the seat base assembly 66 perimeter. As is illustrated in FIG. 16, each one of the upwardly extending side walls and each one of the front and rear walls may include a horizontal outwardly extending flange upon which the seat base assembly 66 may be mounted. A frame may be included with the seat base assembly 66. The frame may extend around the seat base assembly 66 in order to impart stiffness and strength thereto such that the seat base assembly 66 may support the weight of the patient.

The bottom panel, side walls, and front and rear walls of the storage compartment 64 cooperate with an underside of the seat base assembly 66 to define a single volume of the storage compartment 64. Alternatively, the storage compartment 64 may include a vertically disposed divider panel extending upwardly from the bottom panel, as is shown in FIG. 14. The divider panel may be configured to divide the storage compartment 64 into a forward section 74 and an aft section 76. The aft section 76 may include a removable drawer 80 for containing various items. For example, the drawer 80 may provide a place to store the plastic sheet that may be used in transferring the patient between the stretcher topping 62 and the article.

Other items may also be stored in the drawer 80 such as plastic bags for use with the potty panel 70 during patient evacuation, as will be discussed in greater detail below. The drawer 80 may be configured such that it may be slidably advanced into and withdrawn from the aft section 76 similar to the operation of a clothes dresser drawer 80. A handle or small opening 90 may be included on an outward facing or exposed side of the drawer 80 similar to the opening 90 shown in FIG. 15. The opening 90 may allow for the easy withdrawal and re-insertion of the drawer 80 into the aft section 76 of the storage compartment 64.

Referring still to FIGS. 14 and 16, the seat base assembly 66 may be comprised of a removable seat panel 68 and a potty panel 70. The seat panel 68 may preferably be sized and configured such that is stackable upon and removable from a similarly sized one of the potty panels 70. As can be seen in FIGS. 14 and 15, the potty panel 70 has an aperture 72 formed therethrough that opens into the storage compartment 64. For configurations of the storage compartment 64 that include the divider panel, the aperture 72 may be located such that it opens into the forward section 74 only and does not open into the aft section 76. The aperture 72 may preferably be approximately centered between sides of the stretcher topping 62 such that the patient may evacuate while being supported by the potty panel 70 without having to move to either side 46 of the seat base assembly 66. During use of the potty panel 70, the seat panel 68 is temporarily removed to expose the potty panel 70. Although configurable in a number of different shapes and sizes, the aperture 72 may preferably have a generally rounded or oval shape and may be sized approximately as shown in FIGS. 14 and 15.

An additional feature of the second embodiment relates to the lateral sliding capability of the storage compartment 64. In order to enhance this feature such that the stretcher topping 62 may be moved close to the patient during transfers, the storage compartment 64 may extend across only a portion of the seat base assembly 66 as compared to configurations wherein the storage compartment 64 extends across an entire width of the seat base assembly 66. This feature allows the stretcher topping 62 to be laterally moved toward one of the main wheels 14 until a side wall of the storage compartment 64 contacts the main wheel 14. Such a scenario may occur if the stretcher topping 62 were lowered to the first level 54. However, if the stretcher topping 62 were raised up to the second level 56, the bottom panel of the storage compartment 64 may be configured such that it clears the main wheels 14 when laterally extended thereover.

Both the potty panel 70 perimeter and the seat panel 68 perimeter may be shaped and sized to generally match the shape and size of the storage compartment 64 perimeter such that the frame thereof may collectively support the potty panel 70 and the seat panel 68. The potty panel 70 may be fabricated of plastic material such that it may be easily cleaned after use. The seat panel 68 may also be fabricated of plastic material that may further be covered with a padded cushioning material in order to provide a soft layer upon which the patient may be comfortably supported for an extended period of time. However, it is contemplated that the potty panel 70 and the seat panel 68 may be fabricated from a variety of materials including but not limited to metal, fiberglass, wood, or any combination thereof. Both the seat panel 68 and the potty panel 70 may be removably attached to the storage compartment 64 such that each may be cleaned.

The stretcher topping 62 further includes the seat back 20 which is configured to be reclinable. The seat back 20 is hingedly connected to and pivotable about an aft end of the seat base. The seat back 20 is preferably configured to be positioned at any orientation between and including generally horizontal and vertical orientations. As was earlier mentioned, the seat back 20 may be folded on top of the seat base assembly 66 in order to reduce the size of the wheelchair 10 for storability and transportability purposes.

In addition, the seat back 20 may be extended outwardly in the substantially horizontal orientation as is illustrated in FIG. 12. Like the seat panel 68, the seat back 20 may be fabricated from a variety of alternative materials or combinations thereof. Regardless of the particular material from which it is fabricated, it is contemplated that the seat back 20 may be covered with a padded cushioning material to provide a soft, comfortable layer upon which the patient may rest. A relatively thick padded cushion (not shown) may be placed against the seat back 20 to increase patient comfort while sitting in the wheelchair 10 with the patient's legs hanging down. For example, the padded cushion may be sized to be about four inches thick such that the twenty-four inch length of the seat base assembly 66 is reduced to about twenty inches in length to allow the patient to sit upright in a more erect position.

However, during use of the potty panel 70, the padded cushion may be removed and the patient moved headward to allow the forward part 68*a* of the seat panel 68 to be removed exposing the potty panel 70, as will be described in greater detail below. Although not shown in the second embodiment, a head rest 22 similar to that described above and shown in FIGS. 1–9 may be included with the seat back 20. Arm rests 24 may also be included with the wheelchair 10. An arm rest 24 may be secured to each of opposing sides 46 of the wheelchair 10. The arm rest 24 may be configured to be removable in a manner similar to the arm rest 24 of the first embodiment.

The arm rests 24 may be oriented such that they are substantially horizontally disposed above sides 46 of the seat base. The arm rests 24 may further be vertically and/or laterally pivotably attached to the seat back 20 and may each be supported with foldable braces that may be swung up inside of the arm rests 24 such that the arm rests 24 may be folded down flat in alignment with the seat back 20. In this manner, the patient may be slid on and off of the stretcher topping 62 without encountering obstructions. The arm rests 24 may be configured in a manner similar to that described above for the first embodiment and as shown in FIGS. 1–4. At least one security beam 26 may be attached to one of the arm rests 24 as shown in FIGS. 1-4. Alternatively, the security beam 26 may be inserted underneath the arm rest 24 wherein a socket is provided for engagement with the security beam 26.

The push handle 84 may be inserted under the seat back 20 to act as a prop for the seat back 20. The push handle 84 can be seen in FIG. 12 as extending upwardly from the rear 44 of the support frame 12 to an underside of the seat back 20 where it may be locked into place while the patient is laying on the stretcher topping 62. The push handle 84 may be configured to be telescoping such that its height may be reduced during non-use. The telescoping feature of the push handle 84 also allows variable length adjustment thereof such that, depending on whether the stretcher topping 62 is positioned at the first level 54, the second level 56 or an intermediate level, the push handle 84 may be extended up to the level of the seat back 20. The telescoping feature of the push handle 84 also allows for adjusting its height to suit a particular user of the push handle 84.

Figure 13:
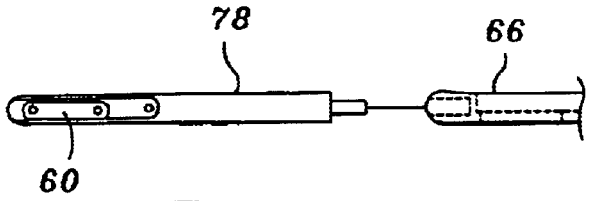
FIG. 13 is a exploded partial side view of a leg support removably attachable to a seat base assembly of the wheelchair of the second embodiment.
Figure 17:
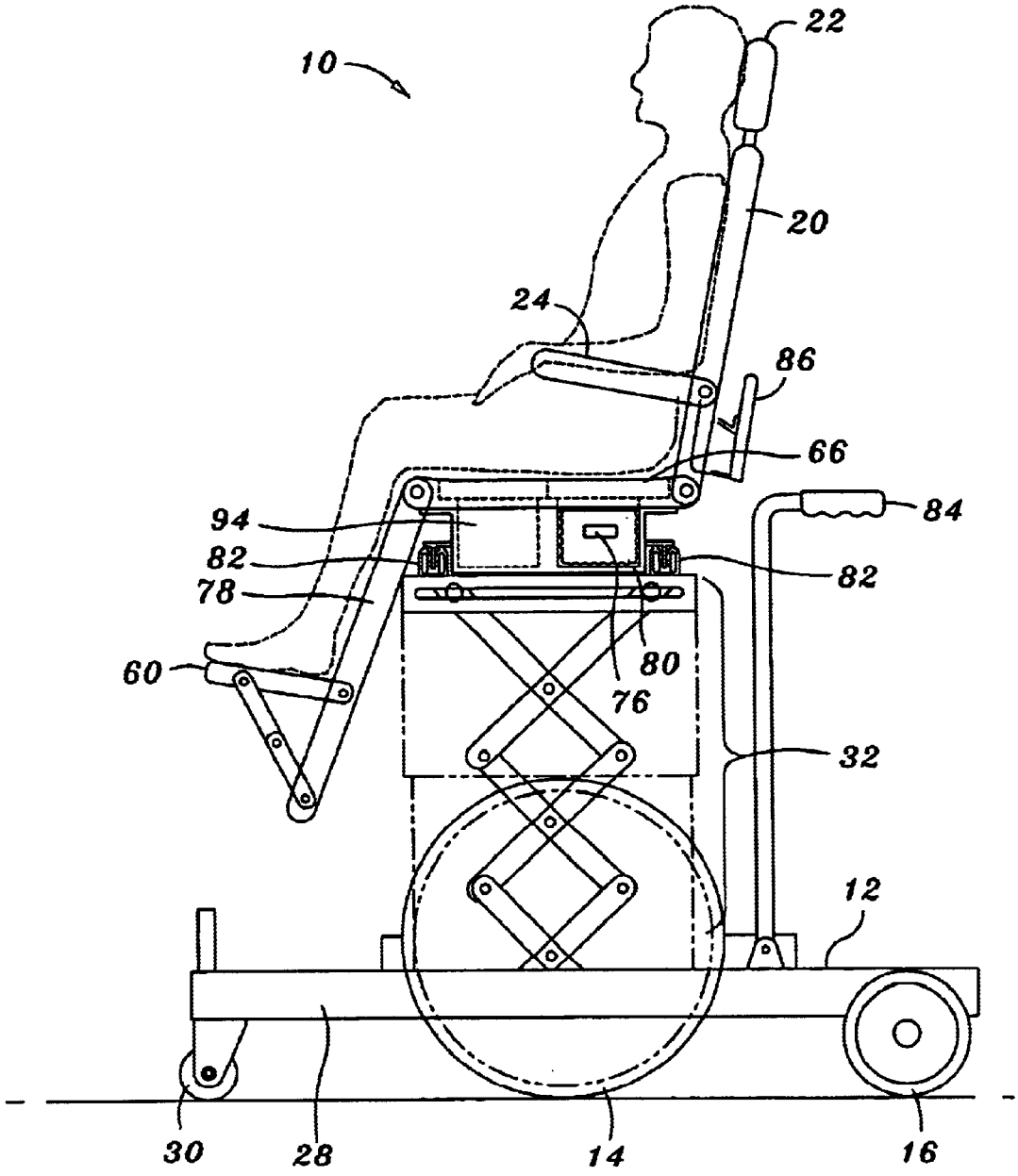
FIG. 17 is side elevational view of the wheelchair of the second embodiment raised to the second level via the lifting mechanism.

Referring still to FIGS. 13–15, a leg support 78 may be included with the stretcher topping 62. The leg support 78 may be removably connected to and pivotable about the forward end of the seat base between and including substantially horizontal and vertical orientation, similar to that described above for the seat back 20. The leg support 78 is shown in the substantially horizontal orientation in FIGS. 12–13 and in a downwardly angled orientation in FIGS. 16-17. The leg support 78 may include pins for mating with complementary sockets in a front 42 of the seat base assembly 66 such that the leg support 78 may be readily removed to reduce the overall size of the stretcher topping 62. In addition, the leg support 78 may include an outwardly pivotable or foldable foot rest 60 secured thereto as is shown in FIGS. 15–17.

The foot rest 60 may be supported by a folding brace disposed on opposing sides 46 of the leg support 78. Alternatively, the foot rest 60 may be supported by a single brace disposed in an approximate center of the foot rest 60. The foot rest 60 may preferably be configured such that it may foldable down against the leg support 78 to allow the patient's legs to extend outstretched on the stretcher topping 62. It is contemplated that the foot rest 60 may be altogether removable from the leg support 78. During use, the foot rest 60 may be laid flat against the leg support 78 if the patient is lying prone or supine on the stretcher topping 62. If the patient is to be placed in a seated position, the foot rest 60 may be extended outwardly as shown in FIGS. 15–17 such that the patient's feet may rest thereupon. Similar to the construction of the seat panel 68 and the seat back 20, the leg support 78 may be fabricated of any material including wood, metal, plastic or any combination thereof. The leg support 78 may further be covered with a padded cushioning material in order to provide a soft layer to support the weight of the patient.

Collectively, the seat base assembly 66, the seat back 20 and the leg support 78 may be sized and configured such that the stretcher topping 62 has an overall length and width that will accommodate a wide variety of patients of varying physical proportions. Toward this end, it is contemplated that the stretcher topping 62 may be about sixteen inches in width. The seat base assembly 66 may have a length of about twenty-four inches with the seat panel 68 and the potty panel 70 being of the same dimensions. Alternatively, the potty panel 70 may have a length of about twelve inches while the seat panel 68 may be provided in two parts including an aft part 68*b* and a forward part 68*a* for a combined length of about twenty-four inches for the seat panel 68.

The forward part 68*a* may be removably secured to the storage compartment 64 above the potty panel 70 while the aft part 68*b* may be either removably or non-removably secured to the storage compartment 64. The aperture 72 in the potty panel 70 may preferably be oval shaped, as is illustrated in FIG. 15, although numerous other shapes are contemplated. Such oval-shaped aperture 72 may preferably have a length of about twelve inches along a major axis and about six inches along a minor axis. A plastic bag such as a trash bag liner may be inserted through the aperture 72 with an upper end of the plastic bag being taped around a perimeter of the aperture 72 prior to evacuation of the patient. After evacuation, the plastic bag may be removed and the seat panel 68 replaced on the potty panel 70, as will be described in greater detail below.

The divider panel, if included, may be positioned such that the forward section 74 of the storage compartment 64 has a length of about twelve inches and the aft section 76 has a similar length such that the potty panel 70 covers the forward section 74 only, and not the aft section 76. Of course, the respective lengths of the forward and aft sections 74, 76 of the storage compartment 64 may vary depending upon the location of the divider panel within the storage compartment 64 and the overall length of the storage compartment 64. The side walls and the front and rear wall may be sized such that the storage compartment 64 has an overall height of about six inches. The potty panel 70 may preferably be fabricated of plastic such as molded plastic, as was earlier mentioned. The potty panel 70 may have a thickness of about ⅛ of an inch while the seat panel 68 may have a thickness of about ¼ of an inch.

The seat panel 68 may optionally be divided into two parts with one part covering the aft section 76 and being fixed thereupon. The other part of the seat panel 68 may be sized to cover the potty panel 70 such that removal of the forward part 68*a* of the seat panel 68 exposes the potty panel 70. As was earlier mentioned, the potty panel 70 may be configured such that it is removable for easy cleaning. The forward part 68*a* of the seat panel 68 may also be removable in order to expose the potty panel 70. Both parts of the seat panel 68 may be sized to have the same thickness and may be fabricated of the same material with padding covering a substantial portion of each of the forward and aft parts 68*a*, 68*b* to increase patient comfort.

The width of the storage compartment 64 may be sized to be equal to that of the seat panel 68. More preferably however, the storage compartment 64 may be sized such that it spans about ⅓ of a width of the seat base assembly 66. If the stretcher topping 62 is sized to have a width of about twenty-four inches, the storage compartment 64 may have a width of only eighteen inches such that a six inch wide strip under one of the sides 46 of the seat base assembly 66 is left vacant. This vacant strip allows for the stretcher topping 62 to be laterally moved up to six inches in one direction such that it may be extended over one of the main wheels 14, as was earlier mentioned. As was earlier mentioned, the leg support 78 may be removed to allow such lateral movement of the stretcher topping 62. It will be appreciated that a width of the vacant strip may be varied by varying the width and lateral placement of the storage compartment 64. Such increased width of the vacant strip in turn increases the amount by which the stretcher topping 62 may be laterally extended.

The wheelchair 10 of the second embodiment may further include at least one security beam 26 configured as a hand-hold to aid the patient in transfers to and from the wheelchair 10, as was described above in the first embodiment. The security beam 26 may be disposed adjacent one of the main wheels 14 in a manner similar to that shown in FIG. 9. The security beam 26 may also be disposed adjacent the seat base assembly 66 in a manner similar to that shown in FIGS. 1–4 and as was mentioned above in regards to the first embodiment. In addition, at least one of the security beams 26 may be disposed behind the seat back 20 by plugging into a security beam socket 86 mounted behind the seat back 20 and interposed between the main wheels 14.

Security beam sockets 86 may also be strategically placed in a number of alternative locations on the wheelchair 10 such as on the support frame 12 so that security poles may be secured thereupon for patient support during transfers and during general use of the wheelchair 10. Regardless of their location, it is contemplated that each one of the security beams 26 may be configured to be pivotable between substantially vertical and horizontal orientations. Each one of the security beams 26 may also be configured to be extendable outwardly from the wheelchair 10.

In addition, the anti-tip booms 28 may be included with the wheelchair 10 to prevent tipping when the weight of the patient is concentrated on an end or side 46 of the stretcher topping 62. Each one of the anti-tip booms 28 may be configured in a manner similar to that described above for the first embodiment and as shown in FIGS. 1–5 and 9–11. In this regard, the anti-tip booms 28 may be substantially horizontally disposed adjacent one of the main wheels 14. Furthermore, each one of the anti-tip booms 28 may be configured to axially extendable and project outwardly from the support frame 12. In addition, each one of the anti-tip booms 28 may be configured to be pivotable between the forward direction 48 and the lateral direction 52.

As in the first embodiment of the wheelchair 10 having the seat base, the wheelchair 10 of the second embodiment having the stretcher topping 62 may further include a lifting mechanism 32 configured for selectively raising or lowering the storage compartment 64 and, hence, the stretcher topping 62 between the first level 54 and the second level 56, as shown in FIG. 12. Such selective raising and lowering may be accomplished through the lifting mechanism 32 which may be configured similar to that shown in FIGS. 2, 10 and 11 and as was earlier described in the first embodiment. Such lifting mechanism 32 may be configured as a scissors jack similar to that shown in FIGS. 10–11, 12 and 17 and as described above. A gear train reduction (not shown) may be incorporated with the scissors jack in order to reduce the torque required to turn the crank 58. Alternatively, the lifting mechanism 32 may be configured as a hydraulic jack similar to that shown in FIG. 4 and as was earlier described in the first embodiment.

The operation of the wheelchair 10 of the second embodiment will now be discussed. Although operable in the conventional manner when the stretcher topping 62 is configured for transporting a seated occupant, the wheelchair 10 advantageously includes the additional combined features of the selectively vertically and laterally moveable stretcher topping 62 and storage compartment 64. Importantly, as was mentioned earlier, the present invention allows the patient to transfer from an article of furniture to the wheelchair 10, utilizing the force of gravity so that the patient is moving simultaneously downwardly and laterally. If capable, the patient may grasp the security beam 26, if included, during the transfer to the wheelchair 10. For example, during a transfer of the patient from a bed to the wheelchair 10, the stretcher topping 62 of the wheelchair 10 is configured into the seated configuration by adjusting the seat back 20 and leg support 78 to be horizontally aligned with the seat base assembly 66.

The stretcher topping 62 is laterally moved in conjunction with the storage compartment 64 upon which it is mounted. Once the stretcher topping 62 is moved laterally, the wheelchair 10 may be moved adjacent to the bed and positioned close to the patient in side-by-side arrangement. The height of the stretcher topping 62 may be adjusted so that it is at a lower level than that of the bed. Alternatively, the stretcher topping 62 may be rested upon the bed next to the patient in which case the thickness of the seat base assembly 66 dictates that the bed will necessarily be at a lower level than the stretcher topping 62. However, a one inch height differential is not believed to hinder lateral translation of the patient from the bed to the stretcher topping 62. In such instances, the plastic sheet may be placed across an interface between the side 46 of the stretcher topping 62 and the bed so that a slickness of the plastic sheet reduces the force required to laterally move the patient slightly upwardly onto the stretcher topping 62.

If so equipped, brakes for the main wheels 14 may be engaged to restrict movement thereof. If included, the arm rest 24 nearest the bed may be pivoted from its outwardly facing direction into alignment with the seat back 20 so that it does not block lateral movement of the patient. Likewise, the foot rest 60, if included, may be folded against the leg support 78. A security beam 26 may be attached to the wheelchair 10 and moved to a vertical orientation. If permanently affixed to the wheelchair 10, the security beam 26 may be axially extended in order that the patient may conveniently grasp the security beam 26 during the transfer. The anti-tip booms 28 may be extended to any length and may be pivoted into the forward facing and/or lateral directions 52 as required in order to provide stability against tipping of the wheelchair 10 as may otherwise occur during application of the patient's weight thereupon.

The anti-tip booms 28 act as a brace to prevent the wheelchair 10 from tipping over when weight is placed ahead of the wheelchair 10 or to a side 46 of the wheelchair 10. As was earlier mentioned, the stretcher topping 62 may be laterally translated over one of the main wheels 14 near the bed to decrease the gap over which the patient must be transferred. A flexible plastic sheet may be utilized as a transfer aid to slide the patient across the gap between the wheelchair 10 and the bed. The flexible plastic sheet may also span any differential in height between the wheelchair 10 and the bed. Preferably, the wheelchair 10 may be raised to a level such that the stretcher topping 62 is lower than the bed. By using a flexible plastic sheet, the patient may then be slid slightly downwardly across the gap on the flexible plastic sheet from the bed to the stretcher topping 62. A relatively thick, large-sized towel may also be placed on the plastic sheet to reduce the sliding friction when laterally transferring the patient. The towel may also reduce bruising of the patient.

In order to use the potty panel 70, the stretcher topping 62 is moved into the seated position with the seat back 20 placed in a generally reclined position. The padded cushion, if included, is removed from the seat back 20 and the patient is slid toward the rear 44 of the wheelchair 10 so that the forward part 68*a* of the seat panel 68 may be removed to expose the potty panel 70. A plastic bag is inserted into the aperture 72 with the upper end thereof being spread out and folded over. The plastic bag may be taped down flat to the potty panel 70. The patient is then moved over the aperture 72. Once evacuation of the patient is finished, the patient is moved headward again to allow removal of the plastic bag, the forward part 68*a* of the seat panel 68 is replaced over the potty panel 70 and the patient is then slid forward and placed into a sitting position. The padded cushion may then be replaced and the legs are placed against the leg support 78 and foot rest 60, if included.

The wheelchair 10 of the second embodiment may be motorized similar to the motorized version of the wheelchair 10 of the first embodiment described above. The lifting mechanism 32 of the second embodiment may be motorized in order to allow vertical height adjustment between the first and second levels 54, 56. Furthermore, the stretcher topping 62 may be motorized to pivot the seat back 20 and leg support 78 into the respective orientations whereupon the patient may be moved from a prone or supine position, (i.e., the patient is laying horizontally), up to a more upright sitting position. Power for the motorized version of the first and second embodiments may be supplied by batteries. In the sitting position, the patient can then be wheeled about in the wheelchair 10 under the power of the motor, under their own power, or with the assistance of a caregiver. Transfer of the patient out of the wheelchair 10 and into an article of furniture, such as a living room chair, is accomplished in the reverse order as that described above.

Additional modifications and improvements of the present invention may also be apparent to those of ordinary skill in the art. Thus, the particular combination of parts described and illustrated herein is intended to represent only certain embodiments of the present invention, and is not intended to serve as limitations of alternative devices within the spirit and scope of the invention.

What is claimed is:

1. A wheelchair for transporting a patient, comprising:

a support frame having a front, a rear, and opposing sides, the front and rear facing in respective forward and aft directions, the opposing sides facing in opposing lateral directions;

at least two main wheels mounted on the support frame;

a stretcher topping disposed upon the support frame and configured for selectively raising and lowering the patient between a first level and a second level, the stretcher topping including:

a storage compartment laterally slidably mounted upon the support frame;

a seat base assembly mounted upon the storage compartment and including a removable seat panel stackable upon a potty panel, the potty panel having an aperture formed therethrough and opening into the storage compartment;

a reclinable seat back hingedly connected and pivotable about an aft end of the seat base assembly between generally horizontal and vertical orientations; and a leg support removably connected to and configured to be pivotable about the forward end of the seat base assembly between generally horizontal and vertical orientations.

2. The wheelchair of claim 1 further including at least one security beam disposed adjacent one of the main wheels wherein the security beam is configured as a hand hold for the patient when transferring onto and off of the seat base assembly.

3. The wheelchair or claim 1 wherein the security beam is disposed behind the seat back between the main wheels.

4. The wheelchair of claim 1 wherein the storage compartment extends across only a portion of the seat base assembly width such that lateral sliding movement of the storage compartment allows for laterally extending a portion of the stretcher topping side beyond one of the main wheels.

5. The wheelchair of claim 1 wherein the storage compartment is dividable into forward and aft sections.

6. The wheelchair of claim 5 wherein the potty panel opens into the forward section.

7. The wheelchair of claim 5 wherein the aft section of the storage compartment includes a removable drawer slidably insertable thereinto.

8. The wheelchair of claim 1 wherein the leg support is detachable from the seat base assembly.

9. The wheelchair of claim 1 wherein the leg support includes an outwardly pivotable footrest secured thereto.

10. The wheelchair of claim 2 wherein the security beam is pivotable between substantially horizontal and vertical orientations and projects outwardly from the wheelchair.

11. The wheelchair of claim 10 wherein the security beam is configured to be axially extendable.

12. The wheelchair of claim 1 further comprising at least one transit wheel mounted on the support frame forward of the main wheels.

13. The wheelchair of claim 12 wherein the transit wheel is mounted aft of the main wheels.

14. The wheelchair of claim 1 further comprising a lifting mechanism configured for selectively raising and lowering the storage compartment and stretcher topping.

15. The wheelchair of claim 14 wherein the lifting mechanism comprises a scissors jack.

16. The wheelchair of claim 14 wherein the lifting mechanism comprises a hydraulic jack.

17. The wheelchair of claim 1 further comprising a pair of arm rests, each one of the arm rests being substantially horizontally disposed above a side of the seat base assembly.

18. The wheelchair of claim 17 wherein each one of the arm rests is configured to be laterally pivotable.

19. The wheelchair of claim 17 wherein each one of the arm rests is configured to be foldable into alignment with the seat back.

20. The wheelchair of claim 1 further comprising a pair of anti-tip booms, each one of the anti-tip booms being substantially horizontally disposed adjacent a main wheel and projecting outwardly from the support frame.

21. The wheelchair of claim 20 wherein each one of the anti-tip booms is axially extendable.

22. The wheelchair of claim 20 wherein each one of the anti-tip booms is configured such that it may be laterally pivoted between the forward direction and the lateral direction.

* * * * *